US007466838B1

(12) United States Patent
Moseley

(10) Patent No.: US 7,466,838 B1
(45) Date of Patent: Dec. 16, 2008

(54) ELECTROACOUSTIC DEVICES WITH NOISE-REDUCING CAPABILITY

(75) Inventor: William T. Moseley, 122 Justin Ave., Shreveport, LA (US) 71105

(73) Assignee: William T. Moseley, Shreveport, LA (US)

( * ) Notice: Subject to any disclaimer, the term of this patent is extended or adjusted under 35 U.S.C. 154(b) by 528 days.

(21) Appl. No.: 11/007,397

(22) Filed: Dec. 8, 2004

Related U.S. Application Data

(60) Provisional application No. 60/528,528, filed on Dec. 10, 2003.

(51) Int. Cl.
*H04R 25/00* (2006.01)
*G10K 11/16* (2006.01)
*H04R 1/10* (2006.01)

(52) U.S. Cl. ..... 381/370; 381/71.4; 381/74

(58) Field of Classification Search ..... 381/71, 381/71.6, 71.7, 72, 74, 370, 26, 309, 371, 381/372, 375
See application file for complete search history.

(56) References Cited

U.S. PATENT DOCUMENTS 5,001,763 A 3/1991 Moseley ..... 381/71
5,117,461 A 5/1992 Moseley ..... 381/72
5,134,659 A 7/1992 Moseley ..... 381/72
5,138,663 A 8/1992 Moseley ..... 381/71
5,182,774 A * 1/1993 Bourk ..... 381/71.6
5,524,058 A 6/1996 Moseley ..... 381/71
6,567,525 B1 * 5/2003 Sapiejewski ..... 381/71.6
6,683,965 B1 * 1/2004 Sapiejewski ..... 381/370
6,735,316 B1 * 5/2004 Wurtz ..... 381/74

* cited by examiner

*Primary Examiner*—Brian Ensey
(74) *Attorney, Agent, or Firm*—Connolly Bove Lodge & Hutz LLP

(57) ABSTRACT

New and improved electroacoustic devices each including at least one transducer assembly having one or more microphones typically mounted on a baffle plate and disposed in substantially the same acoustic plane as a speaker or speakers. In the various embodiments, at least one microphone and at least one speaker face the same or opposite directions. Each microphone may be parallel to or oriented at an angle with respect to the speaker. In other embodiments, the speaker includes a central opening or cavity in which a microphone having one of various orientations is provided. The orientations of the microphone or microphones with respect to the speaker or speakers minimize adverse noise reduction effects associated with the differences in sensitivities, frequency responses and phase responses and acoustic time delays between the microphones and the speaker or speakers, as well as minimize sound reflections that are picked up by the microphone or microphones.

20 Claims, 12 Drawing Sheets

ELECTROACOUSTIC DEVICES WITH NOISE-REDUCING CAPABILITY

CROSS-REFERENCE TO RELATED APPLICATIONS

This application claims the benefit of U.S. Provisional application No. 60/528,528, filed Dec. 10, 2003.

FIELD OF THE INVENTION

The present invention relates to electroacoustic devices for translating electronic signals into acoustic signals perceived by the human ear. More particularly, the present invention relates to electroacoustic devices which include novel speaker and microphone configurations that are particularly effective in reducing noise perceived by a listener during use.

BACKGROUND OF THE INVENTION

Electroacoustic devices include headphones, headsets, helmets, speaker enclosures and other devices having electroacoustic functions. Headphones typically include a pair of ear cups mounted on respective ends of an arcuate or C-shaped adjustable headband. Each of the ear cups contains a headphone speaker that converts electrical energy from a television, radio, compact disk (CD), cassette tape or the like into acoustic energy that is perceived by the ears of the wearer. Headsets additionally include a "boom" microphone that is positioned in proximity to the wearer's mouth to permit the wearer to engage in two-way communication with a second person. Most headphones and headsets include some type of noise reduction capability which reduces the quantity of unwanted acoustic energy that reaches the ears of the wearer.

There are two general types of noise-reducing or noise-canceling capability among headphones and headsets. The most basic of these capability types is passive noise attenuation, in which the physical structure of the headphone insulates the wearer's ears from extraneous and unwanted noise. Headphones and headsets characterized by passive noise attenuation may include an acoustically-absorbent material which lines the interior of the ear cups, as well as some form of an ear cushion that lines the edge of each ear cup and presses against the wearer's skin around the ear during use. The second type of noise-canceling capability is known as active noise attenuation and requires an electromechanical device and electronic circuitry. This type of noise-canceling capability results from a combination of active noise attenuation and passive noise attenuation.

Those headphones and headsets having active noise attenuation capability require a microphone or microphones to pick up the original sound and convert this original sound to electrical energy, electronic circuitry to control the electrical energy of the original sound and a speaker to convert the electrical signal back to an acoustic signal. The electronic circuitry inverts the phase of the original sound by 180 degrees and amplifies the signal to an acoustic level which is equal to the level that reaches the wearer's ear. The amplified signal, 180 degrees out of phase with respect to the original signal, cancels the original signal and results in a clearer sound perceived by the ear of the headphone or headset wearer.

One of the problems inherent in conventional active noise reduction designs for headphones is that the microphone or microphones and the speaker used in the headphone have sensitivities, frequency responses and phase responses which differ from each other. Furthermore, the acoustic time delay between the microphone and the speaker causes a phase shift between the original signal and the attenuated signal. Consequently, not all of the frequencies in the original signal will be canceled by the attenuated signal because not all frequencies of the attenuated signal will be 180 degrees out of phase with respect to all frequencies of the original signal. It has been found that placement of a microphone and a speaker in substantially the same acoustic plane minimizes the difference between the sound wave phase or time delay and the sound pressure that acts on the microphone diaphragm with respect to the signal from the speaker.

Another problem that exists in active noise reduction designs is that the microphone or microphones tend to pick up direct reflections of certain frequencies of the original signal. This distorts reproduction of the phase-inverted original signal as the amplified attenuated signal. Accordingly, new and improved electroacoustic devices are needed which are capable of minimizing adverse noise reduction effects associated with the differences in sensitivities, frequency responses and phase responses and acoustic time delays which exist between microphones and speakers, as well as minimizing direct sound reflections picked up by the microphone or microphones.

SUMMARY OF THE INVENTION

The present invention is generally directed to new and improved electroacoustic devices each including one or more microphones typically mounted on a baffle plate and disposed in substantially the same acoustic plane as a speaker or speakers. In the various embodiments, at least one microphone and at least one speaker face the same or opposite directions. In one embodiment, a microphone faces the same direction as the speaker or speakers and is oriented in the same plane as the baffle plate. In another embodiment, the microphone faces the same direction as the speaker or speakers and is oriented at an angle with respect to the plane of the baffle plate. In still another embodiment, the microphone and the speaker or speakers face opposite directions and the microphone is disposed in the same plane as the baffle plate. In yet another embodiment, the microphone and the speaker or speakers face opposite directions and the microphone is disposed at an angle with respect to the plane of the baffle plate. In other embodiments, one microphone faces the same or opposite direction as the speaker or speakers and is disposed in the same plane as the baffle plate or at an angle with respect to the plane of the baffle plate. Another microphone faces the same or different direction as the speaker or speakers and is disposed in the same plane as the baffle plate or at an angle with respect to the plane of the baffle plate. In other embodiments, the speaker includes a central opening or cavity in which a microphone having one of various orientations is provided. The orientations of the microphone or microphones with respect to the speaker or speakers minimize adverse noise reduction effects associated with the differences in sensitivities, frequency responses and phase responses and acoustic time delays between the microphones and the speaker or speakers, as well as minimize direct sound reflections that are picked up by the microphone or microphones.

BRIEF DESCRIPTION OF THE DRAWINGS

The invention will now be described, by way of example, with reference to the accompanying drawings, in which.

DESCRIPTION OF THE INVENTION

Figure 1A:
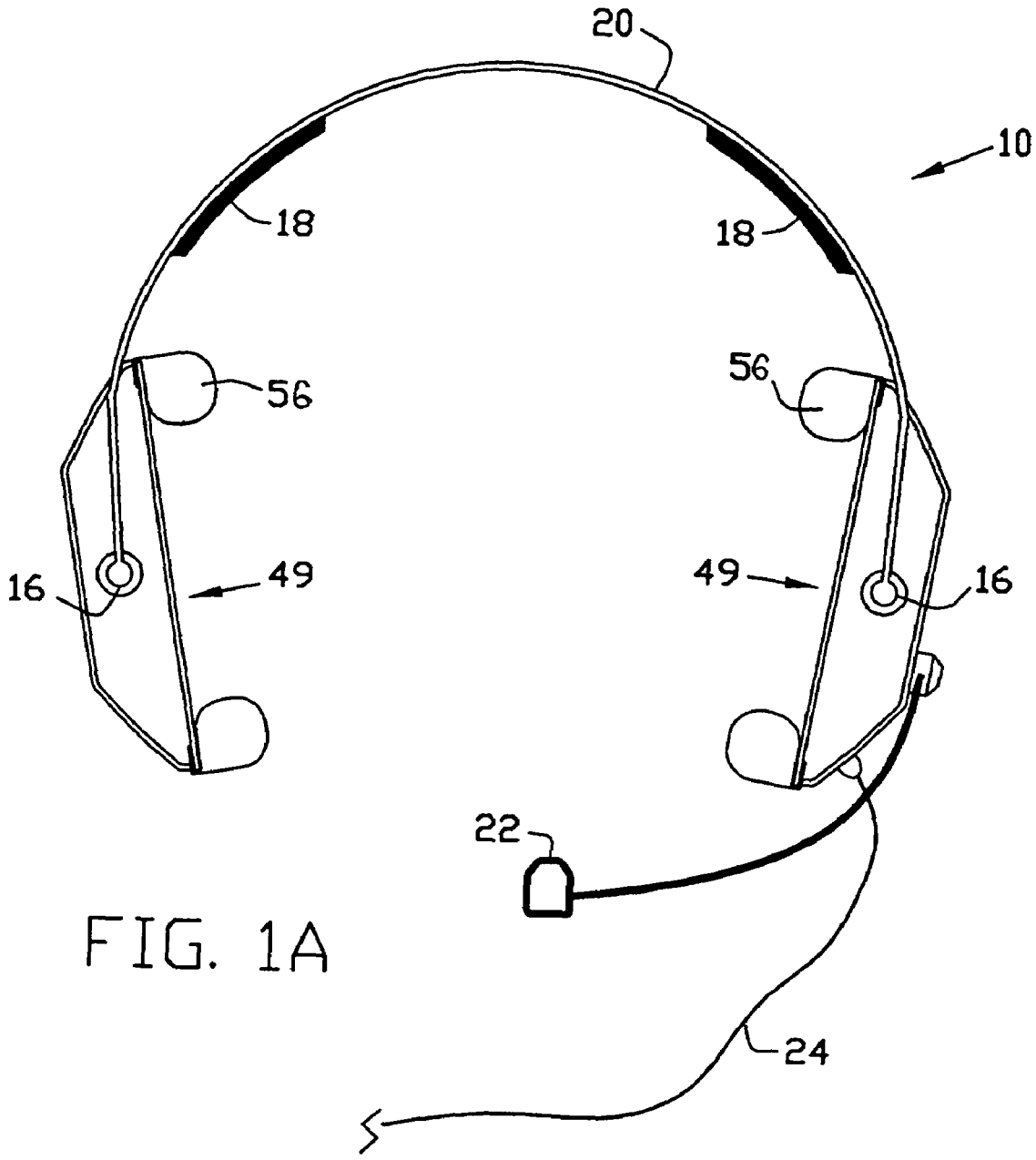
FIG. 1A is a schematic view, partially in section, of an illustrative electroacoustic device of the present invention.

An illustrative embodiment of an electroacoustic device of the present invention is generally indicated by reference numeral 10 in FIG. 1A and includes a first embodiment of a pair of transducer assemblies 49 connected to a pair of attachment points 16 of an adjustable headband 20, optionally including a pad 18. A boom microphone 22 may also be attached to a transducer assembly 49 or to the adjustable headband 20. One end of a cable 24 may be connected to the respective transducer assemblies 49, in which case the opposite end of the cable 24 is adapted for connection to an external device or devices (not shown). Alternatively, the transducer assemblies 49 may have internal electronic circuitry. While the electroacoustic device 10 in FIG. 1A and throughout the drawings is shown in the configuration of a headset, it will be understood that the present invention is equally adaptable to use as a telephone handset, a helmet or other electroacoustic device. Furthermore, the electroacoustic device 10 can be used for headphones and headsets that perform functions such as amplification and monitoring while simultaneously feeding a recording device or that perform multiple functions at the same time.

The transducer assemblies 49 convert an acoustic source signal to an electrical signal and simultaneously convert a processed electrical signal to an acoustic signal. Each transducer assembly 49, the structural details of will be hereinafter described in more detail, is typically encased in a cup-shaped housing and designed to fit directly and comfortably over the ear canal so as not to "plug" the ear and allow the original sound wave which emanates from the speaker to enter the ear canal. Each transducer assembly 49 typically includes an ear cushion 56 which cushions the transducer assembly 49 against the head of a wearer. The adjustable headband 20 can be designed in such a manner as to conceal wires (not shown) crossing from one transducer assembly 49 to the other, thus reducing the risk of damage and aiding in cosmetic appearance of the device 10. The boom microphone 22 may optionally be included as part of the device 10 for communication needs of the wearer. The external device or devices to which the electroacoustic device 10 is connected through the cable 24 is configured to adjust the volume, balance and other characteristics of sound emanating from the apparatus 10, according to the knowledge of those skilled in the art.

For active noise cancelling applications, the electroacoustic device 10 includes components which receive and convert an original acoustic signal to an electrical signal, process the electrical signal with a 180 degree phase shift, and convert it back to a modified wave signal in such a manner that the modified signal can add to and cancel the original acoustic signal in real time. Accordingly, because the modified acoustic signal is substantially 180 degrees out of phase with the original acoustic signal, the modified signal substantially cancels the original acoustic signal. The transducer assemblies 49 are typically the same in construction.

Figure 2:
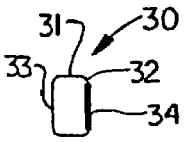
FIG. 2 is a side view of an illustrative microphone suitable for use with the electroacoustic devices of the present invention.

Referring next to FIG. 2 of the drawings, a transmitter or microphone 30 which is suitable for use with the electroacoustic devices of the present invention typically includes a microphone housing 31 having a face 32 through which extends multiple openings (not shown) to enable sound to enter the microphone housing 31. A charged, typically flat diaphragm 34 is provided in the microphone housing 31 and may be located adjacent to the face 32, as shown, or alternatively may be located closer to the back 33 than to the face 32 or about midway between the face 32 and the back 33 of the microphone housing 31. The microphone 30 may be a conventional, omni-directional electret condenser microphone known by those skilled in the art. Such a microphone includes a Field Effect Transistor (FET, not shown) which is positioned in the microphone housing 31. As acoustic energy enters the microphone housing 31 through the openings in the face 32, the charged diaphragm 34 moves proportional to the acoustic energy and the FET converts this change in capacitance into an electrical signal.

Figure 3:
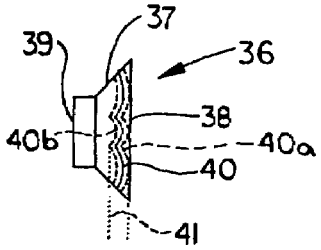
FIG. 3 is a side view of an illustrative speaker suitable for use with the electroacoustic devices of the present invention.

Referring next to FIG. 3 of the drawings, a receiver or speaker 36 which is suitable for use with the electroacoustic devices of the present invention includes a housing 37 having a front 38 and a magnet 39 at the rear of the housing. A movable diaphragm is mounted in the housing 37 and is indicated at rest by the solid line 40. The diaphragm moves in an acoustic plane 41 between a frontmost position 40*a* and a rearmost position 40*b*. Accordingly, the frontmost position 40*a* of the diaphragm defines the frontmost limit of the acoustic plane 41, and the rearmost position 40*b* of the diaphragm defines the rearmost limit of the acoustic plane 41. The speaker 36 may be conventional and further includes a magnet 39 that is contained in the rear portion of the housing 37 and a voice coil (not shown) attached to the diaphragm.

Figure 4:
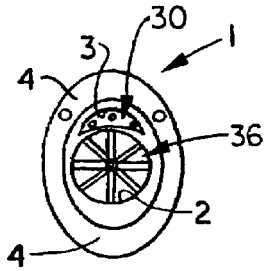
FIG. 4 is a front view of an illustrative baffle plate for mounting a microphone or microphones and a speaker in an electroacoustic device.

Referring next to FIG. 4 and to FIGS. 5A-5D of the drawings, a baffle plate 1 which is suitable for use with the present invention includes a speaker opening 2 through which the front 38 of the speaker 36 (FIG. 3) is exposed. A microphone recess 3 is provided adjacent to the speaker opening 2 and may contain a microphone 30. A rim 4 typically surrounds the speaker opening 2 and the microphone recess 3 and serves to mount the baffle plate 1 in the transducer assembly 49. As shown in FIGS. 5A-5D, the baffle plate 1 may have one of four basic cross-sectional configurations in each of the various embodiments of the invention as hereinafter described.

Figure 5A:
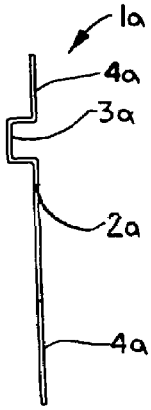
FIG. 5A is a cross-sectional view of a parallel cavity flat baffle plate for mounting a speaker and a microphone or microphones in an electroacoustic device in accordance with the present invention.

As shown in FIG. 5A, a parallel cavity flat baffle plate 1*a* includes a speaker opening 2*a* and an adjacent microphone recess 3*a* surrounded by a rim 4*a*. The microphone recess 3*a* may have a generally rectangular cross-sectional configuration and is generally parallel with respect to the plane of the rim 4*a*. The parallel cavity flat baffle plate 1*a* is designed to impart a "straight" configuration to the transducer assembly such that the speaker 36 and the microphone or microphones 30 are held in a parallel position with respect to the ear of a person wearing the electroacoustic device, as hereinafter further described.

Figure 5B:
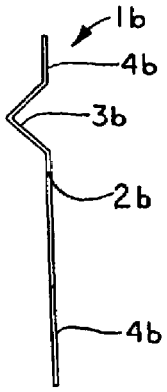
FIG. 5B is a cross-sectional view of an angled cavity flat baffle plate for mounting a speaker and a microphone or microphones in an electroacoustic device in accordance with the present invention.

As shown in FIG. 5B, an angled cavity flat: baffle plate 1*b* includes a speaker opening 2*b* and an adjacent microphone recess 3*b* surrounded by a rim 4*b*. The microphone recess 3*b* has a cross-sectional configuration which is generally bi-angled with respect to the plane of the rim 4*b*. Like the parallel cavity flat baffle plate 1*a* of FIG. 5A, the angled cavity flat baffle plate 1*b* is designed to impart a "straight" configuration to the transducer assembly.

Figure 5C:
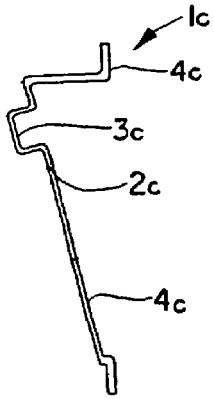
FIG. 5C is a cross-sectional view of a parallel cavity slant baffle plate for mounting a speaker and a microphone or microphones in an electroacoustic device in accordance with the present invention.

As shown in FIG. 5C, a parallel cavity slant baffle plate 1*c* includes a speaker opening 2*c* and an adjacent microphone recess 3*c* surrounded by a rim 4*c*. The microphone recess 3*c* may have a generally rectangular cross-sectional configuration and is generally parallel with respect to the plane of the rim 4*c*. The parallel cavity slant baffle plate 1*c* is designed to impart a sloped configuration to the transducer assembly such that the speaker 36 and the microphone or microphones 30 are positioned at an angle with respect to the ear of a person wearing the electroacoustic device, as hereinafter further described.

Figure 5D:
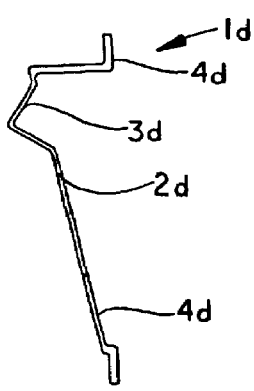
FIG. 5D is a cross-sectional view of an angled cavity slant baffle plate for mounting a speaker and a microphone or microphones in an electroacoustic device in accordance with the present invention.

As shown in FIG. 5D, an angled cavity slant baffle plate 1*d* includes a speaker opening 2*d* and an adjacent microphone recess 3*d* surrounded by a rim 4*d*. The microphone recess 3*d* has a cross-sectional configuration which is generally bi-angled with respect to the plane of the rim 4*d*. Like the parallel cavity slant baffle plate 1*c* of FIG. 5C, the angled cavity slant baffle plate 1*d* imparts a sloped configuration to the transducer assembly as hereinafter described.

Figure 6A:
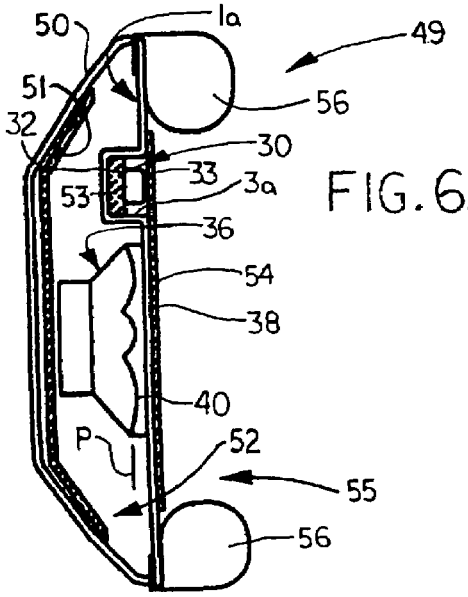
FIG. 6A is a cross-sectional view of a flat baffle plate design for an transducer assembly in a first embodiment of the electroacoustic devices of the present invention.

Referring next to FIG. 6A, in a first embodiment each transducer assembly 49 of the electroacoustic device 10 includes a generally concave housing 50 which may be completely closed, partially closed or completely open with respect to the exterior of the transducer assembly 49. A piece of acoustic foam 51, herein after referred to in the various embodiments as outer acoustic foam, is typically provided on the interior surface of the housing 50 to attenuate sound wave reflections and resonance. A parallel cavity flat baffle plate 1*a*, heretofore described with respect to FIG. 5A, is mounted to the housing 50. Accordingly, an outer cavity 52 is defined between the housing 50 and the rear surface of the parallel cavity flat baffle plate 1*a*, with the outer acoustic foam 51 provided in the outer cavity 52. A speaker 36 is typically mounted to the rear surface of the baffle plate 1*a*, with the front 38 of the speaker 36 disposed in communication with the speaker opening 2*a* (FIG. 5A) in the baffle plate 1*a*. A generally flat piece of acoustic foam 53, hereinafter referred to in the various embodiments as microphone acoustic foam, is typically provided in the microphone recess 3*a*. A microphone 30 is mounted to the baffle plate 1*a*, inside the microphone recess 3*a*, and the face 32 of the microphone 30 faces the microphone acoustic foam 53. The microphone acoustic foam 53 helps reduce resonance problems and attenuates some frequencies. The diaphragm 34 (FIG. 2) of the microphone 30 and the diaphragm 40 of the speaker 36 are disposed in substantially the same acoustic plane "P" and the face 32 of the microphone 30 and the front 38 of the speaker 36 face substantially opposite directions. A sheet of acoustic foam 54, hereinafter referred to in the various embodiments as inner acoustic foam, is provided on the interior surface of the baffle plate 1*a* and typically encloses the microphone 30 in the microphone recess 3*a* to provide a finished cosmetic appearance to the transducer assembly 49. The inner acoustic foam 54 also protects the speaker 36 and the microphone 30 from dust and other particles that could damage the speaker 36 and/or microphone 30, and maybe a water-resistant material to additionally protect the speaker 36 and the microphone 30 from moisture. An ear cushion 56 is provided on the exterior surface of the rim 4*a* of the baffle plate 4 to cushion the transducer assembly 49 against the head of a wearer. An inner cavity 55 is defined by the ear cushion 56 and between the inner acoustic foam 54 and the wearer's head (not shown).

Figure 1B:
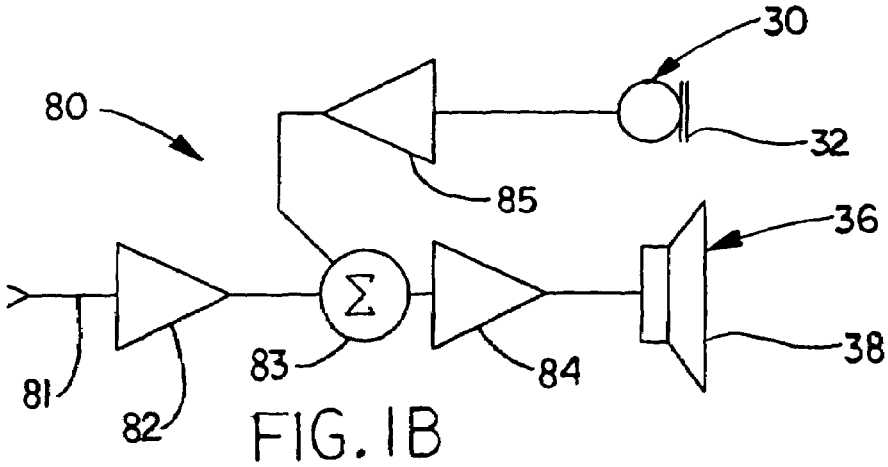
FIG. 1B is a block diagram of an illustrative signal processing circuit for an electroacoustic device of the present invention.
Figure 1C:
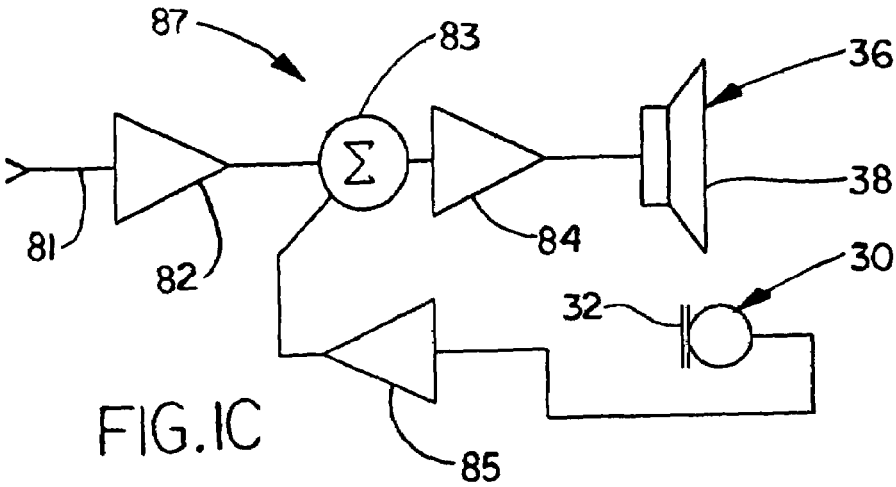
FIG. 1C is a block diagram of another illustrative signal processing circuit for an electroacoustic device of the present invention.

Referring next to FIG. 1C, an illustrative signal processing circuit 87 for the transducer assembly 49 includes an external audio input 81 which is connected to a summing circuit 83 through an audio preamplifier 82. The summing circuit 83 is, in turn, connected to the speaker 36 through a speaker amplifier 84. The microphone 30 is connected to the summing circuit 83 through a microphone preamplifier 85. The face 32 of the microphone 30 and the front 38 of the speaker 36 face substantially opposite directions. In operation of the transducer assembly 49, the external audio input 81 receives an input electrical signal from a source (not shown). The input electrical signal is amplified by the audio preamplifier 82 and then modified as desired and transmitted through the summing circuit 83 to the speaker amplifier 84. The speaker amplifier 84 further amplifies the input electrical signal to suitable levels to drive the diaphragm 40 of the speaker 36, which converts the input electrical signal to an original sound wave that is transmitted from the speaker 36 into the inner cavity 55 (FIG. 6A) of the transducer assembly 49. For active noise cancellation, the microphone 30 simultaneously receives and converts the original sound wave into a converted electrical signal which is amplified by the microphone preamplifier 85 and transmitted to the summing circuit 83. The summing circuit 83 then shifts the phase of the converted electrical signal 180 degrees, or the signal may be shifted elsewhere in the circuit, and the phase-shifted electrical signal is amplified by the speaker amplifier 84 to drive the diaphragm 40 of the speaker 36. Accordingly, a phase-shifted sound wave combines with and cancels the original sound wave in the inner cavity 55. Consequently, the phase-shifted sound wave omits extraneous acoustic distortions from the original sound wave as the phase-shifted sound wave impinges on the ear of the wearer. It will be understood that the signal processing circuit 87 shown in FIG. 1C includes the simplest configuration required to effect the external audio input signal processing, and that additional circuitry can be used to correct the effects of re-processing.

Figure 6B:
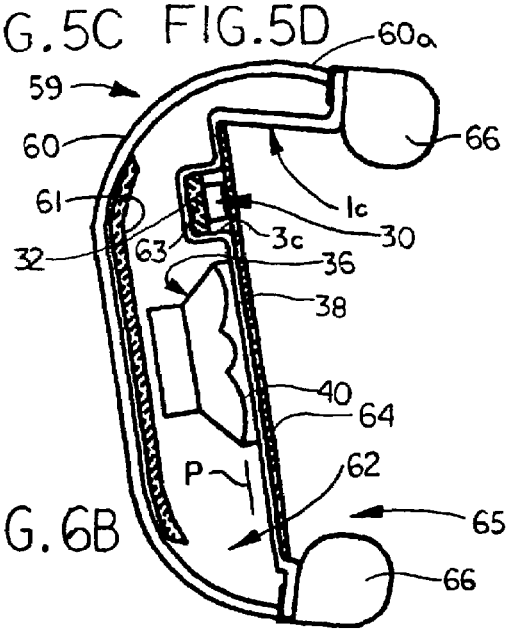
FIG. 6B is a cross-sectional view of a slant baffle plate design for an transducer assembly in a first embodiment of the electroacoustic devices of the present invention.

Referring next to FIG. 6B, in an alternative first embodiment each transducer assembly 59 includes a generally concave housing 60 which includes a housing extension 60*a* in the upper portion thereof to facilitate positioning of the interior transducer assembly components away from the ear of a wearer. A piece of outer acoustic foam 61 is typically provided on the interior surface of the housing 60 to attenuate sound wave reflections and resonance. A parallel cavity slant baffle plate 1*c*, heretofore described with respect to FIG. 5C, is mounted to the housing 60. An outer cavity 62 is defined between the housing 60 and the rear surface of the baffle plate 1*c*, with the outer acoustic foam 61 provided in the outer cavity 62. A speaker 36 is typically mounted to the rear surface of the baffle plate 1*c*, with the front 38 of the speaker 36 disposed in communication with the speaker opening 2*c* (FIG. 5C) in the baffle plate 1C. A piece of microphone acoustic foam 63 is typically provided in the microphone recess 3*c*, and the face 32 of a microphone 30 mounted to the baffle plate 1*c* inside the microphone recess 3*c* faces the microphone acoustic foam 63. The diaphragm 34 (FIG. 2) of the microphone 30 and the diaphragm 40 of the speaker 36 are disposed in substantially the same acoustic plane "P", and the face 32 of the microphone 30 and the front 38 of the speaker 36 face substantially opposite directions. A sheet of inner acoustic foam 64 is provided on the interior surface of the baffle plate 1*c* and typically encloses the microphone 30 in the microphone recess 3*c*. An ear cushion 66 is provided on the exterior surface of the rim 4*c* of the baffle plate 1*c* to cushion the transducer assembly 59 against the head of a wearer. An inner cavity 65 is defined by the ear cushion 66 and between the inner acoustic foam 64 and the wearer's head (not shown). Due to the slanted configuration of the baffle plate 1*c* in combination with the housing extension 60*a* of the housing 60, the microphone 30 and the speaker 36 are angled away from the ear (not shown) of a wearer, across the inner cavity 65.

Figure 7A:
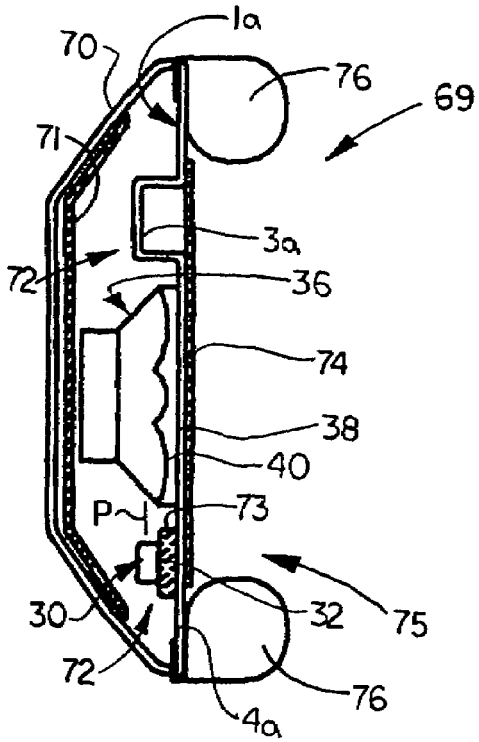
FIG. 7A is a cross-sectional view of a flat baffle plate design for an transducer assembly in a second embodiment of the electroacoustic devices.

Referring next to FIG. 7A, in a second embodiment each transducer assembly 69 includes a generally concave housing 70 and a piece of outer acoustic foam 71 typically provided on the interior surface of the housing 70. A parallel cavity flat baffle plate 1*a*, heretofore described with respect to FIG. 5A, is mounted to the housing 70 to define an outer cavity 72 between the housing 70 and the rear surface of the parallel cavity flat baffle plate 1*a*, with the outer acoustic foam 71 provided in the outer cavity 72. A speaker 36 is typically mounted to the rear surface of the baffle plate 1*a*, with the front 38 of the speaker 36 disposed in communication with the speaker opening 2*a* (FIG. 5A) in the baffle plate 1*a*. A piece of microphone acoustic foam 73 is typically provided on the rear surface of the rim 4*a* of the baffle plate 1*a*, inside the outer cavity 72. The face 32 of a microphone 30 mounted to the baffle plate 1*a* faces the microphone acoustic foam 73. The diaphragm 34 (FIG. 2) of the microphone 30 and the diaphragm 40 of the speaker 36 are disposed in substantially the same acoustic plane "P", and the face 32 of the microphone 30 and the front 38 of the speaker 36 face substantially the same direction. A sheet of inner acoustic foam 74 is provided on the interior surface of the baffle plate 1*a*. An ear cushion 76 is provided on the exterior surface of the rim 4*a* of the baffle plate 4 to cushion the transducer assembly 69 against the head of a wearer. A front cavity 75 is defined by the ear cushion 76 between the inner acoustic foam 74 and the wearer's head (not shown). A simple signal processing circuit 80 which is suitable for the transducer assembly 69 is shown in FIG. 1B and includes an external audio input 81, an audio preamplifer 82, a summing circuit 83, a speaker amplifier 84 and a microphone preamplifier 85. The face 32 of the microphone 30 and the front 38 of the speaker 36 are oriented in substantially the same direction.

Figure 7B:
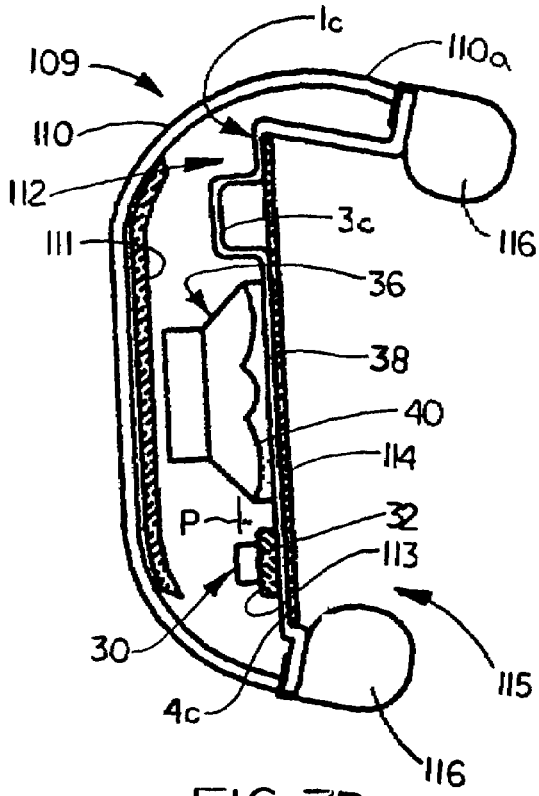
FIG. 7B is a cross-sectional view of a slant baffle plate design for an transducer assembly in a second embodiment of the electroacoustic devices.

Referring next to FIG. 7B, in an alternative second embodiment each transducer assembly 109 includes a generally concave housing 110 which includes a housing extension 110*a* in the upper portion thereof to facilitate positioning of the interior transducer assembly components away from the ear of a wearer. A piece of outer acoustic foam 111 is typically provided on the interior surface of the housing 110. A parallel cavity slant baffle plate 1*c*, heretofore described with respect to FIG. 5C, is mounted to the housing 110. An outer cavity 112 is defined between the housing 110 and the rear surface of the baffle plate 1*c*, with the outer acoustic foam 111 provided in the outer cavity 112. A speaker 36 is typically mounted to the rear surface of the baffle plate 1*c*, with the front 38 of the speaker 36 disposed in communication with the speaker opening 2*c* (FIG. 5C) in the baffle plate 1*c*. A piece of microphone acoustic foam 113 is typically provided on the rear surface of the baffle plate 1*c*, inside the outer cavity 112, and the face 32 of a microphone 30 mounted to the baffle plate 1*c* faces the microphone acoustic foam 113. The diaphragm 34 (FIG. 2) of the microphone 30 and the diaphragm 40 of the speaker 36 are disposed in substantially the same acoustic plane "P", and the face 32 of the microphone 30 and the front 38 of the speaker 36 face substantially the same direction. A sheet of inner acoustic foam 114 is provided on the interior surface of the baffle plate 1*c*. An ear cushion 116 is provided on the exterior surface of the rim 4*c* of the baffle plate 1*c* to cushion the transducer assembly 109 against the head of a wearer. An inner cavity 115 is defined by the ear cushion 116 between the inner acoustic foam 114 and the wearer's head (not shown). Due to the slanted configuration of the baffle plate 1*c* in combination with the housing extension 110*a* of the housing 110, the microphone 30 and the speaker 36 are angled away from the ear (not shown) of a wearer, across the inner cavity 115.

Figure 8A:
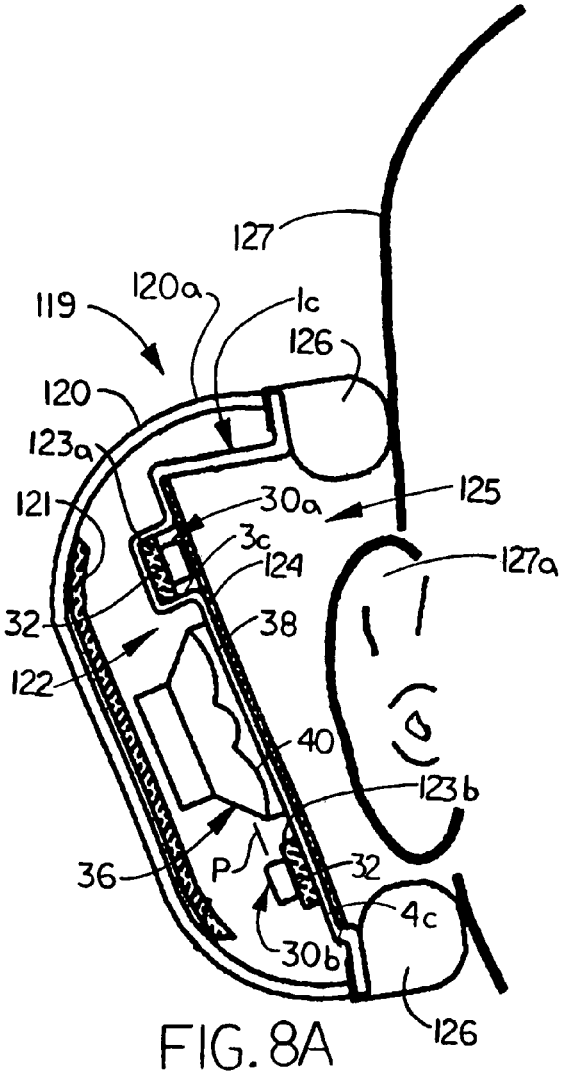
FIG. 8A is a cross-sectional view of a slant baffle plate design for an transducer assembly in a third embodiment of the electroacoustic devices.

Referring next to FIG. 8A, in a third embodiment each transducer assembly 119 includes a generally concave housing 120 which includes a housing extension 120*a* in the upper portion thereof to facilitate positioning of the interior transducer assembly components away from the ear 127*a* of a wearer. A piece of outer acoustic foam 121 is typically provided on the interior surface of the housing 120. A parallel cavity slant baffle plate 1*c* is mounted to the housing 120. An outer cavity 122 is defined between the housing 120 and the rear surface of the baffle plate 1*c*, with the outer acoustic foam 121 provided in the outer cavity 122. A speaker 36 is typically mounted to the rear surface of the baffle plate 1*c*, with the front 38 of the speaker 36 disposed in communication with the speaker opening 2*c* (FIG. 5C) in the baffle plate 1*c*. A generally flat piece of microphone acoustic foam 123*a* is provided in the microphone recess 3*c* of the baffle plate 1*c*. The face 32 of a first microphone 30*a*, mounted to the baffle plate 1*c* inside the microphone recess 3*c*, faces the microphone acoustic foam 123*a*. A second piece of microphone acoustic foam 123*b* is typically provided on the rear surface of the baffle plate 1*c*, inside the outer cavity 122, and the face 32 of a second microphone 30*b* mounted to the baffle plate 1*c* faces the microphone acoustic foam 123*b*. The diaphragm 34 (FIG. 2) of the first microphone 30*a* and the diaphragm 40 of the speaker 36 are disposed in substantially the same acoustic plane "P". The face 32 of the first microphone 30*a* and the front 38 of the speaker 36 face substantially opposite directions. The diaphragm 34 of the second microphone 30*b* and the diaphragm 40 of the speaker 36 are disposed in substantially the same acoustic plane "P", and the face 32 of the second microphone 30*b* and the front 38 of the speaker 36 face substantially the same direction. A sheet of inner acoustic foam 124 is provided on the interior surface of the baffle plate 1*c* and covers the first microphone 30*a* in the microphone recess 3*c*. An ear cushion 126 is provided on the exterior surface of the rim 4*c* of the baffle plate 1*c* to cushion the transducer assembly 119 against the head 127 of a wearer. An inner cavity 125 is defined by the ear cushion 126 between the inner acoustic foam 124 and the wearer's head 127. Due to the slanted configuration of the baffle plate 1*c* in combination with the housing extension 120*a* of the housing 120, the first microphone 30*a*, the second microphone 30*b* and the speaker 36 are angled away from the ear 127*a* of the wearer, across the inner cavity 125.

Figure 1D:
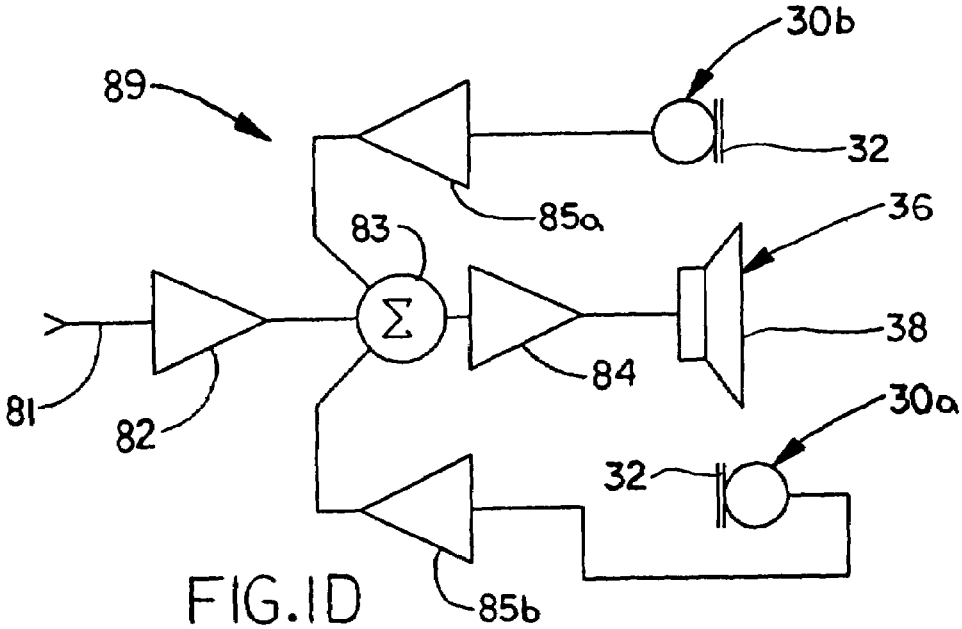
FIG. 1D is a block diagram of still another illustrative signal processing circuit for an electroacoustic device of the present invention.

Referring next to FIG. 1D, an illustrative signal processing circuit 89 for the transducer assembly 119 includes an external audio input 81 connected to a summing circuit 83 through an audio preamplifier 82, a speaker amplifier 84 of the speaker 36 connected to the summing circuit 83, a first microphone amplifier 85*a* connected to the first microphone 30*a* and to the summing circuit 83, and a second microphone amplifier 85*b* connected to the second microphone 30*b* and the summing circuit 83. In operation of the transducer assembly 89, the external audio input 81 receives an input electrical signal, which is amplified by the audio preamplifier 82 and then transmitted through the summing circuit 83 to the speaker amplifier 84 to ultimately drive the diaphragm 40 of the speaker 36. The speaker 36 converts the input electrical signal to an original sound wave that is transmitted from the speaker 36 into the inner cavity 125 (FIG. 6A) of the transducer assembly 119. Simultaneously, the first microphone 30*a* and the second microphone 30*b* receive and convert the original sound wave into respective electrical signals which are amplified by the respective first microphone preamplifiers 85*a* and second microphone preamplifier 85*b*, and these electrical signals are transmitted to the summing circuit 83. The summing circuit 83 then sums the electrical signals and shifts the phase of the electrical signals 180 degrees (or the phase of the signals may be shifted elsewhere in the circuit), and the phase-shifted electrical signal is amplified by the speaker amplifier 84 to drive the diaphragm 40 of the speaker 36 for active noise cancellation functions. The phase-shifted sound wave emanating from the speaker 36 combines with and cancels the original sound wave in the inner cavity 125. Consequently, the phase-shifted sound wave omits extraneous acoustic distortions from the original sound wave as the phase-shifted sound wave impinges on the ear of the wearer. It will be understood that the signal processing circuit 89 shown in FIG. 1D includes the simplest configuration required to effect the external audio input signal processing, and that additional circuitry can be used to correct the effects of re-processing.

Figure 8B:
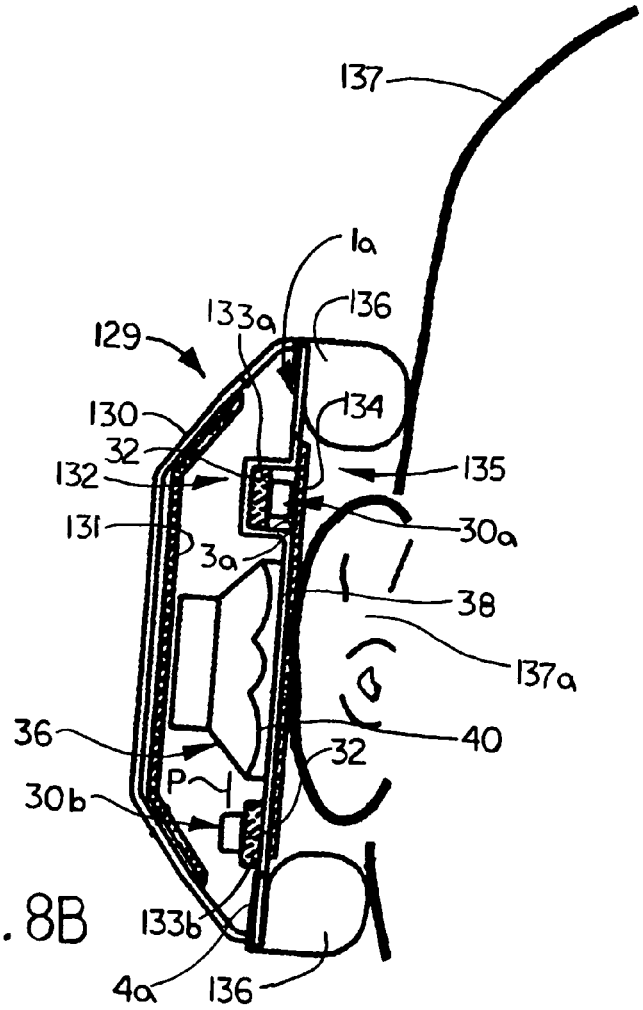
FIG. 8B is a cross-sectional view of a flat baffle plate design for an transducer assembly in a third embodiment of the electroacoustic devices.

Referring next to FIG. 8B, in an alternative third embodiment each transducer assembly 129 includes a generally concave housing 130 and a piece of outer acoustic foam 131 typically provided on the interior surface of the housing 130. A parallel cavity flat baffle plate 1*a* is mounted to the housing 130 to define an outer cavity 132 between the housing 130 and the rear surface of the parallel cavity flat baffle plate 1*a*, with the outer acoustic foam 131 provided in the outer cavity 132. A speaker 36 is mounted to the baffle plate 1*a*, with the front 38 of the speaker 36 disposed in communication with the speaker opening 2*a* (FIG. 5A) in the baffle plate 1*a*. A generally flat piece of microphone acoustic foam 133*a* is provided in the microphone recess 3*a* of the baffle plate 1*a*. The face 32 of a first speaker 30*a*, mounted to the baffle plate 1*a* inside the microphone recess 3*a*, faces the microphone acoustic foam 133*a*. A second generally flat piece of microphone acoustic foam 133*b* is provided on the rear surface of the rim 4*a* of the baffle plate 1*a*, and the face 32 of a second microphone 30*b* mounted to the baffle plate 1*a* faces the microphone acoustic foam 133*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face substantially opposite directions, whereas the face 32 of the second microphone 30*b* and the front 38 of the speaker 36 face substantially the same direction. A sheet of inner acoustic foam 134 is provided on the interior surface of the baffle plate 1*a* and covers the first microphone 30*a* in the microphone recess 3*a*. An ear cushion 136 is provided on the inner surface of the rim 4*a* of the baffle plate 4 to cushion the transducer assembly 129 against the head 137 of a wearer as the transducer assembly 129 fits over the wearer's ear 137*a*. An inner cavity 135 is defined by the ear cushion 136 between the inner acoustic foam 134 and the wearer's head 137.

Figure 9A:
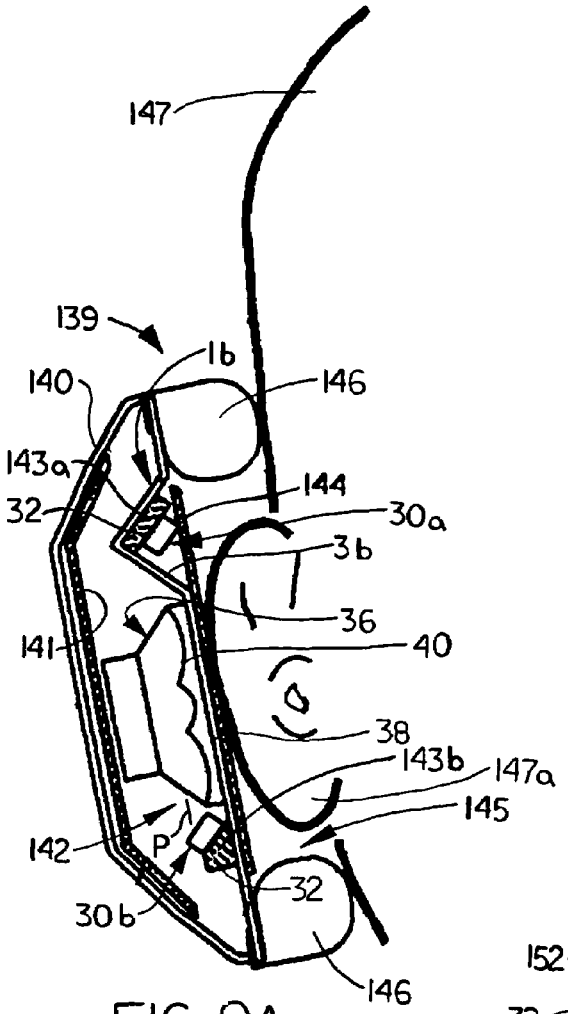
FIG. 9A is a cross-sectional view of a flat baffle plate design for an transducer assembly in a fourth embodiment of the electroacoustic devices.

Referring next to FIG. 9A, in a fourth embodiment each transducer assembly 139 includes a generally concave housing 140 and a piece of outer acoustic foam 141 typically provided on the interior surface of the housing 140. An angled cavity flat baffle plate 1*b* (FIG. 5B) is mounted to the housing 140 to define an outer cavity 142 between the housing 140 and the rear surface of the parallel baffle plate 1*b*. A speaker 36 is mounted to the baffle plate 1*b*. A flat piece of microphone acoustic foam 143*a* is provided on one of the angled surfaces of the bi-angled microphone recess 3*b* in the baffle plate 1*b*. A first microphone 30*a* mounted to the baffle plate 1*b* has a face 32 which is angled toward the microphone acoustic foam 143*a*. An angled piece of microphone acoustic foam 143*b* is provided on the rear surface of the rim 4*b* of the baffle plate 1*b*, and the face 32 of a second microphone 30*b* mounted to the baffle plate 1*b* faces the microphone acoustic foam 143*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face generally opposite directions, and the face 32 of the first microphone 30*a* is angled away from the speaker 36. The face 32 of the second microphone 30*b* and the front 38 of the speaker 36 face generally the same direction, and the face 32 of the second microphone 30*b* is angled away from the speaker 36. The faces 32 of both the first microphone 30*a* and the second microphone 30*b* are oriented at an angle of about 1-90 degrees with respect to the front 38 of the speaker 36, and the first microphone 30*a* and the second microphone 30*b* face opposite directions. A sheet of inner acoustic foam 144 is provided on the interior surface of the baffle plate 1*b* and covers the first microphone 30*a* in the microphone recess 3*b*. An ear cushion 146 is provided on the inner surface of the rim 4*b* of the baffle plate 1*b* to cushion the transducer assembly 139 against the head 147 of a wearer as the transducer assembly 139 fits over the wearer's ear 147*a*. An inner cavity 145 is defined by the ear cushion 146 between the inner acoustic foam 144 and the wearer's head 147. The transducer assembly 139 may be used in conjunction with the signal processing circuit 89 of FIG. 1D, except with the face 32 of the first microphone 30*a* and the face 32 of the second microphone 30*b* each angled away from the speaker 36.

Figure 9B:
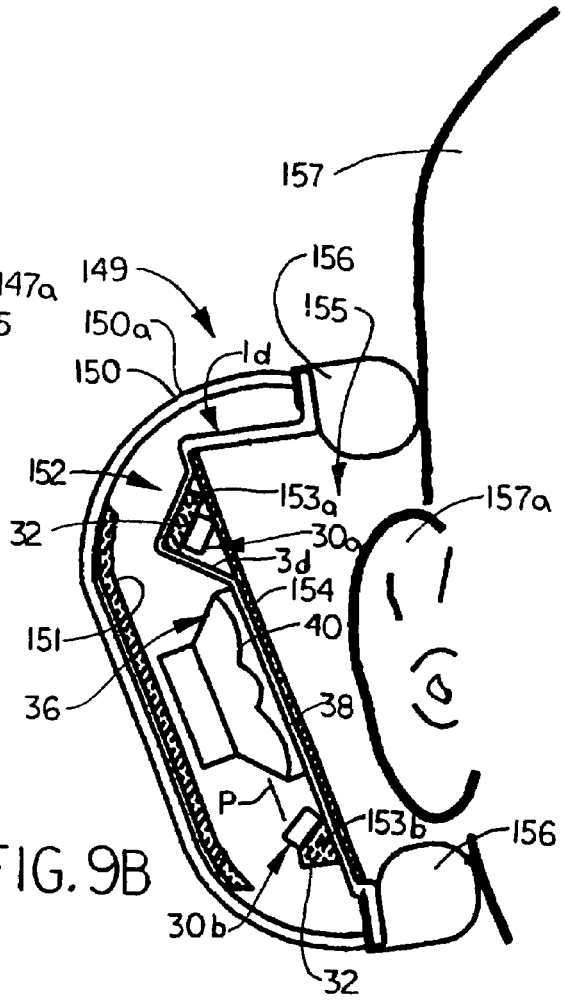
FIG. 9B is a cross-sectional view of a slant baffle plate design for an transducer assembly in a fourth embodiment of the electroacoustic devices.

Referring next to FIG. 9B, in an alternative fourth embodiment each transducer assembly 149 includes a generally concave housing 150 which includes a housing extension 150*a* in the upper portion thereof to facilitate positioning of the interior transducer assembly components away from the ear 157*a* of a wearer. A piece of outer acoustic foam 151 is typically provided on the interior surface of the housing 150. An angled cavity slant baffle plate 1*d* is mounted to the housing 150. An outer cavity 152 is defined between the housing 150 and the rear surface of the baffle plate 1*d*. A speaker 36 is typically mounted to the rear surface of the baffle plate 1*d*. A flat piece of microphone acoustic foam 153*a* is provided on one of the angled surfaces of the bi-angled microphone recess 3*d* in the baffle plate 1*d*. The face 32 of a first microphone 30*a* mounted to the baffle plate 1*d* faces the flat microphone acoustic foam 153*a*. An angled piece of microphone acoustic foam 153*b* is provided on the rear surface of the rim 4*d* of the baffle plate 1*d*, and the face 32 of a second microphone 30*b* mounted to the baffle plate 1*d* faces the angled microphone acoustic foam 153*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the face 32 of the second microphone 30*b* face opposite directions, with the first microphone 30*a* and the speaker 36 facing generally opposite directions. The faces 32 of both the first microphone 30*a* and the second microphone 30*b* are oriented at an angle of about 1-90 degrees with respect to the front 38 of the speaker 36, and the face 32 of the first microphone 30*a* and the face 32 of the second microphone 30*b* are oriented away from the speaker 36. A sheet of inner acoustic foam 154 is provided on the interior surface of the baffle plate 1*d* and covers the first microphone 30*a* in the microphone recess 3*d*. An ear cushion 156 is provided on the exterior surface of the rim 4*d* of the baffle plate 1*d* to cushion the transducer assembly 149 against the head 157 of a wearer. An inner cavity 155 is defined by the ear cushion 156 between the inner acoustic foam 154 and the wearer's head 157. Due to the slanted configuration of the baffle plate 1*d* in combination with the housing extension 150*a* of the housing 150, the first microphone 30*a*, the second microphone 30*b* and the speaker 36 are angled away from the ear 157*a* of the wearer, across the inner cavity 155.

Figure 10A:
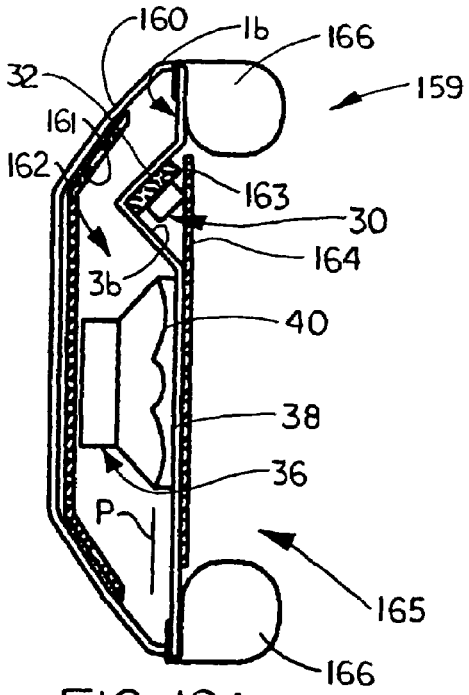
FIG. 10A is a cross-sectional view of a flat baffle plate design for an transducer assembly in a fifth embodiment of the electroacoustic devices.

Referring next to FIG. 10A, in a fifth embodiment each transducer assembly 159 includes a generally concave housing 160 and a piece of outer acoustic foam 161 typically provided on the interior surface of the housing 160. An angled cavity flat baffle plate 1*b* (FIG. 5B) is mounted to the housing 160, defining an outer cavity 162. A speaker 36 is typically mounted to the rear surface of the baffle plate 1*b*. A flat piece of microphone acoustic foam 163 is provided on one of the angled surfaces of the bi-angled microphone recess 3*b*, and the face 32 of a microphone 30 mounted to the baffle plate 1*b* faces the microphone acoustic foam 163. The diaphragm 34 (FIG. 2) of the microphone 30 and the diaphragm 40 of the speaker 36 are disposed in substantially the same acoustic plane "P". The face 32 of the microphone 30 is angled away from the speaker 36, and the face 32 of the microphone 30 and the front 38 of the speaker 36 face generally opposite directions. The face 32 of the microphone 30 is disposed at an angle of typically about 1-90 degrees with respect to the front 38 of the speaker 36. A sheet of inner acoustic foam 164 is provided on the interior surface of the baffle plate 1*b* and typically encloses the microphone 30 in the microphone recess 3*b*. An ear cushion 166 is provided on the exterior surface of the rim 4*b* of the baffle plate 4. An inner cavity 165 is defined by the ear cushion 166 and between the inner acoustic foam 174 and the wearer's head (not shown). The transducer assembly 159 may be used in conjunction with the signal processing circuit 87 of FIG. 1C, except with the face 32 of the microphone 30 angled away from the speaker 36.

Figure 10B:
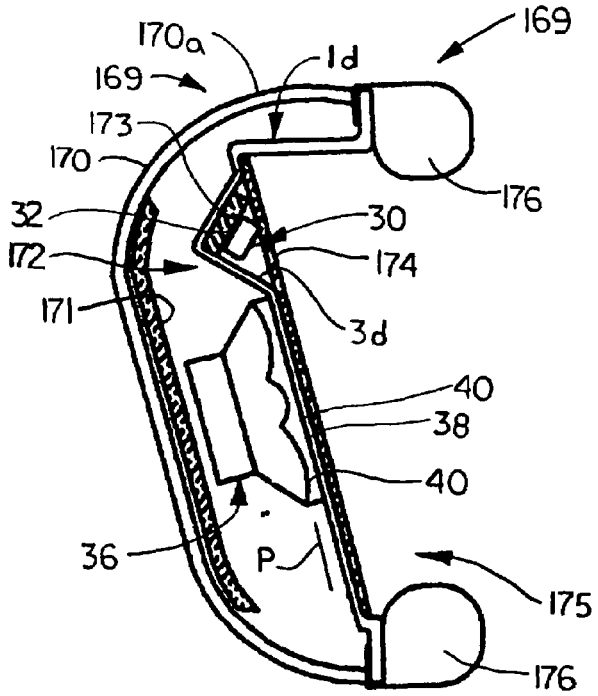
FIG. 10B is a cross-sectional view of a slant baffle plate design for an transducer assembly in a fifth embodiment of the electroacoustic devices.

Referring next to FIG. 10B, in an alternative fifth embodiment each transducer assembly 169 includes a generally concave housing 170 which includes a housing extension 170*a*. A piece of outer acoustic foam 171 is typically provided on the interior surface of the housing 170. An angled cavity slant baffle plate 1*d* is mounted to the housing 170. An outer cavity 172 is defined between the housing 170 and the rear surface of the baffle plate 1*d*. A speaker 36 is typically mounted to the rear surface of the baffle plate 1*d*. A flat piece of microphone acoustic foam 173 is typically provided on one of the angled surfaces of the microphone recess 3*d*, and the face 32 of a microphone 30 mounted to the baffle plate 1*d* faces the microphone acoustic foam 173. The diaphragm 34 (FIG. 2) of the microphone 30 and the diaphragm 40 of the speaker 36 are disposed in substantially the same acoustic plane "P", and the face 32 of the microphone 30 is angled away from the speaker 36, with the face 32 of the microphone 30 disposed at an angle of about 1-90 degrees with respect to the front 38 of the speaker 36. The face 32 of the microphone 30 and the front 38 of the speaker 36 face generally opposite directions. A sheet of inner acoustic foam 174 is provided on the interior surface of the baffle plate 1*d* and typically encloses the microphone 30 in the microphone recess 3*d*. An ear cushion 176 is provided on the exterior surface of the rim 4*d* of the baffle plate 1*d*. An inner cavity 175 is defined by the ear cushion 176 and between the inner acoustic foam 174 and the wearer's head (not shown). Due to the slanted configuration of the baffle plate 1*d* in combination with the housing extension 170*a* of the housing 170, the microphone 30 and the speaker 36 are angled away from the ear (not shown) of a wearer, across the inner cavity 175. A simple signal processing circuit 87 which is suitable for the transducer assembly 169 is shown in FIG. 1C and includes an external audio input 81, an audio preamplifer 82, a summing circuit 83, a speaker amplifier 84 and a microphone preamplifier 85. The face 32 of the microphone 30 and the front 38 of the speaker 36 are oriented in generally opposite directions.

Figure 11A:
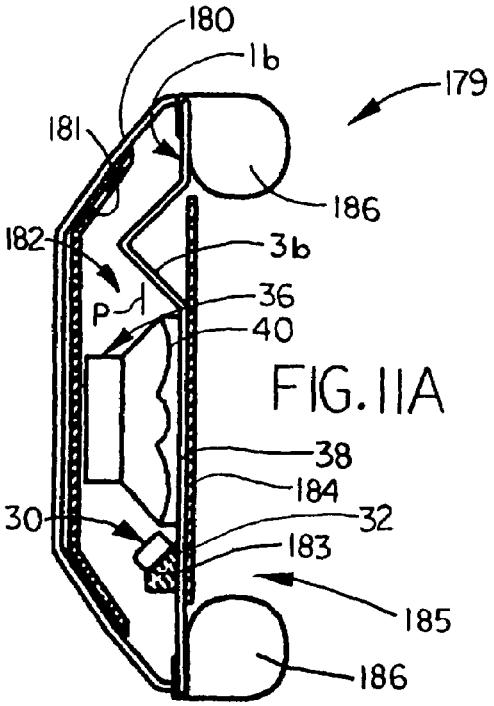
FIG. 11A is a cross-sectional view of a flat baffle plate design for an transducer assembly in a sixth embodiment of the electroacoustic devices.

Referring next to FIG. 11A, in a sixth embodiment each transducer assembly 179 includes a generally concave housing 180 and a piece of outer acoustic foam 181 typically provided on the interior surface of the housing 180. An angled cavity flat baffle plate 1*b* (FIG. 5B) is mounted to the housing 180, defining an outer cavity 182. A speaker 36 is typically mounted to the rear surface of the baffle plate 1*b*. An angled piece of microphone acoustic foam 183 is provided on the rear surface of the baffle plate 1*b*, and the face 32 of a microphone 30 mounted to the baffle plate 1*d* faces the microphone acoustic foam 183. The diaphragm 34 (FIG. 2) of the microphone 30 and the diaphragm 40 of the speaker 36 are disposed in substantially the same acoustic plane "P". The face 32 of the microphone 30 is angled or tilted away from the speaker 36 at an angle of typically about 1-90 degrees with respect to the front 38 of the speaker 36, with the face 32 of the microphone 32 and the front 38 of the speaker 36 facing generally the same direction. A sheet of inner acoustic foam 184 is provided on the interior surface of the baffle plate 1*b*. An ear cushion 186 is provided on the exterior surface of the rim 4*b* of the baffle plate 1*b*. An inner cavity 185 is defined by the ear cushion 186 and between the inner acoustic foam 184 and the wearer's head (not shown). A simple signal processing circuit 80 which is suitable for the transducer assembly 179 is shown in FIG. 1B and includes an external audio input 81, an audio preamplifer 82, a summing circuit 83, a speaker amplifier 84 and a microphone preamplifier 85. The face 32 of the microphone 30 and the front 38 of the speaker 36 are oriented in generally the same direction.

Figure 11B:
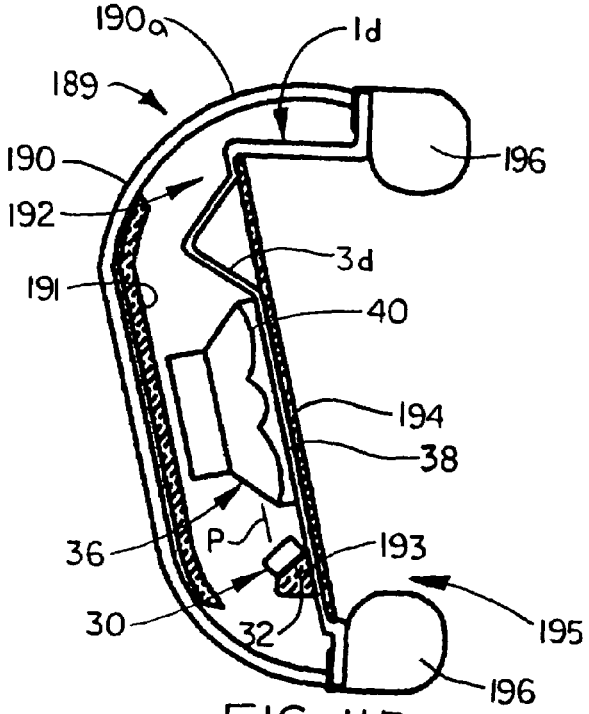
FIG. 11B is a cross-sectional view of a slant baffle plate design for an transducer assembly in a sixth embodiment of the electroacoustic devices.

Referring next to FIG. 11B, in an alternative sixth embodiment each transducer assembly 189 includes a generally concave housing 190 which includes a housing extension 190*a*. A piece of outer acoustic foam 191 is typically provided on the interior surface of the housing 190. An angled cavity slant baffle plate 1*d* is mounted to the housing 190. An outer cavity 192 is defined between the housing 190 and the rear surface of the baffle plate 1*d*. A speaker 36 is typically mounted to the rear surface of the baffle plate 1*d*. An angled piece of microphone acoustic foam 193 is provided on the rear surface of the baffle plate 1*d*, and the face 32 of a microphone 30 mounted to the baffle plate 1*d* faces the microphone acoustic foam 193. The diaphragm 34 (FIG. 2) of the microphone 30 and the diaphragm 40 of the speaker 36 are disposed in substantially the same acoustic plane "P". The face 32 of the microphone 30 is angled or tilted away from the speaker 36 at an angle of typically about 1-90 degrees with respect to the front 38 of the speaker 36, with the face 32 of the microphone 32 and the front 38 of the speaker 36 facing generally the same direction. A sheet of inner acoustic foam 194 is provided on the interior surface of the baffle plate 1*d*. An ear cushion 196 is provided on the exterior surface of the rim 4*d* of the baffle plate 1*d*. An inner cavity 195 is defined by the ear cushion 196 and between the inner acoustic foam 194 and the wearer's head (not shown). Due to the slanted configuration of the baffle plate 1*d* in combination with the housing extension 190*a* of the housing 190, the microphone 30 and the speaker 36 are angled away from the ear (not shown) of a wearer, across the inner cavity 195. A simple signal processing circuit 80 which is suitable for the transducer assembly 189 is shown in FIG. 1B.

Figure 12A:
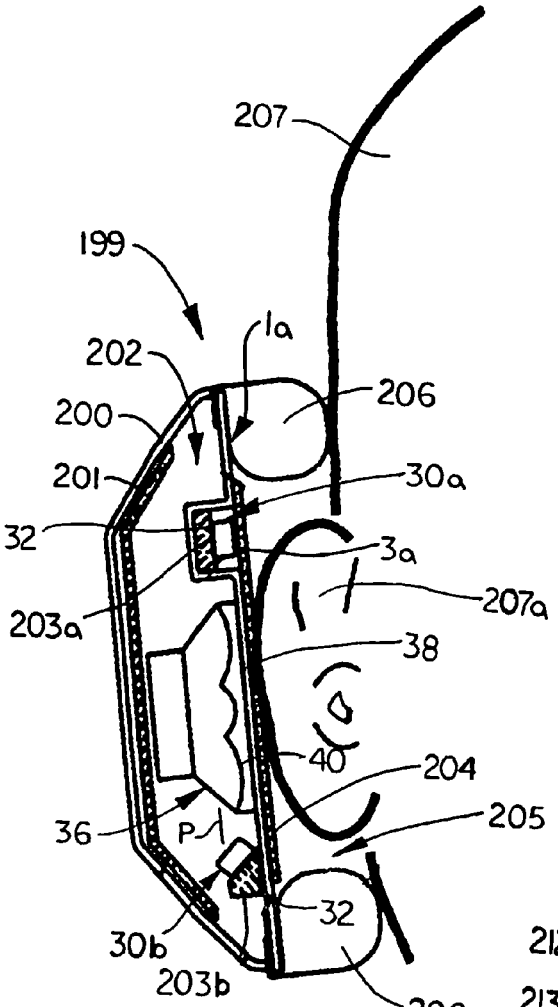
FIG. 12A is a cross-sectional view of a flat baffle plate design for an transducer assembly in a seventh embodiment of the electroacoustic devices.

Referring next to FIG. 12A, in a seventh embodiment each transducer assembly 199 includes a generally concave housing 200 and a piece of outer acoustic foam 201 typically provided on the interior surface of the housing 200. A parallel cavity flat baffle plate 1*a* is mounted to the housing 200 to define an outer cavity 202 between the housing 200 and the rear surface of the parallel cavity flat baffle plate 1*a*, with the outer acoustic foam 201' provided in the outer cavity 202. A speaker 36 is mounted to the baffle plate 1*a*. A flat piece of microphone acoustic foam 203*a* is provided in the microphone recess 3*a* of the baffle plate 1*a*. The face 32 of a first speaker 30*a*, mounted to the baffle plate 1*a* inside the microphone recess 3*a*, faces the microphone acoustic foam 203*a*. An angled piece of microphone acoustic foam 203*b* is provided on the rear surface of the rim 4*a* of the baffle plate 1*a*, and the face 32 of a second microphone 30*b* mounted to the baffle plate 1*a* faces the microphone acoustic foam 203*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face substantially opposite directions, whereas the face 32 of the second microphone 30*b* and the front 38 of the speaker 36 face generally the same direction with the microphone 30*b* angled or tilted away from the speaker 36 at an angle of typically about 1-90 degrees with respect to the front 38 of the speaker 36. A sheet of inner acoustic foam 204 is provided on the interior surface of the baffle plate 1*a* and covers the first microphone 30*a* in the microphone recess 3*a*. An ear cushion 206 is provided on the inner surface of the rim 4*a* of the baffle plate 4 to cushion the transducer assembly 199 against the head 207 of a wearer as the transducer assembly 199 fits over the wearer's ear 207*a*. An inner cavity 205 is defined by the ear cushion 206 between the inner acoustic foam 204 and the wearer's head 207. A simple signal processing circuit 89 which is suitable for the transducer assembly 189 is shown in FIG. 1D and includes an external audio input 81, an audio preamplifer 82, a summing circuit 83, a speaker amplifier 84 and microphone preamplifiers 85*a*, 85*b*. A speaker 36 is connected to the speaker amplifier 84. First and second microphones 30*a*, 30*b* are connected to the respective preamplifiers 85*b*, 85*a*, respectively. The face 32 of the microphone 30*a* and the front 38 of the speaker 36 are oriented in opposite directions, whereas the face 32 of the microphone 30*b* and the front 38 of the speaker 36 are oriented in substantially the same direction. As simple signal processing circuit 89 which is suitable for the transducer assembly 199 is shown in FIG. 1D.

Figure 12B:
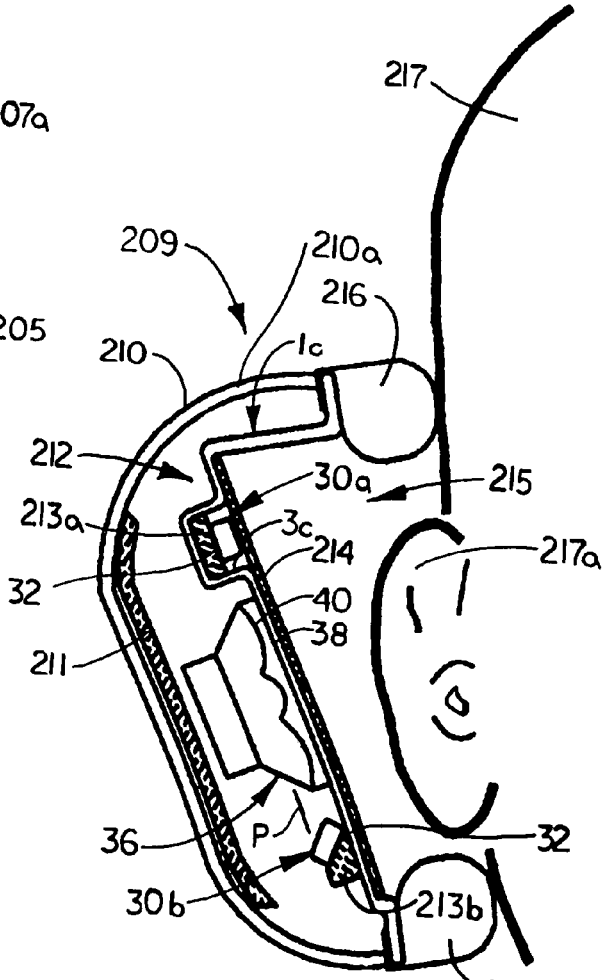
FIG. 12B is a cross-sectional view of a slant baffle plate design for an transducer assembly in a seventh embodiment of the electroacoustic devices.

Referring next to FIG. 12B, in an alternative seventh embodiment each transducer assembly 209 includes a generally concave housing 210 which includes a housing extension

210*a* in the upper portion thereof to facilitate positioning of the interior transducer assembly components away from the ear 127*a* of a wearer. A piece of outer acoustic foam 211 is typically provided on the interior surface of the housing 210. A parallel cavity slant baffle plate 1*c* is mounted to the housing 210. An outer cavity 212 is defined between the housing 210 and the rear surface of the baffle plate 1*c*. A speaker 36 is typically mounted to the rear surface of the baffle plate 1*c*. A flat piece of microphone acoustic foam 213*a* is provided in the microphone recess 3*c* of the baffle plate 1*c*. The face 32 of a first microphone 30*a*, mounted to the baffle plate 1*c* inside the microphone recess 3*c*, faces the microphone acoustic foam 213*a*. An angled piece of microphone acoustic foam 213*b* is provided on the rear surface of the rim 4*a* of the baffle plate 1*c*. The face 32 of a second microphone 30*b* mounted to the baffle plate 1*c* faces the microphone acoustic foam 213*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face generally opposite directions, whereas the face 32 of the second microphone 30*b* is angled or tilted away from the speaker 36 at an angle of typically about 1-90 degrees with respect to the front 38 of the speaker 36 and faces generally the same direction as the front 38 of the speaker 36. A sheet of inner acoustic foam 214 is provided on the interior surface of the baffle plate 1*c* and covers the first microphone 30*a* in the microphone recess 3*c*. An ear cushion 216 is provided on the exterior surface of the rim 4*c* of the baffle plate 1*c* to cushion the transducer assembly 209 against the head 217 of a wearer. An inner cavity 215 is defined by the ear cushion 216 between the inner acoustic foam 214 and the wearer's head 217. Due to the slanted configuration of the baffle plate 1*c* in combination with the housing extension 210*a* of the housing 2120, the first microphone 30*a*, the second microphone 30*b* and the speaker 36 are oriented away from the ear 217*a* of the wearer, across the inner cavity 215. A simple signal processing circuit 89 which is suitable for the transducer assembly 209 is shown in FIG. 1D.

Figure 13A:
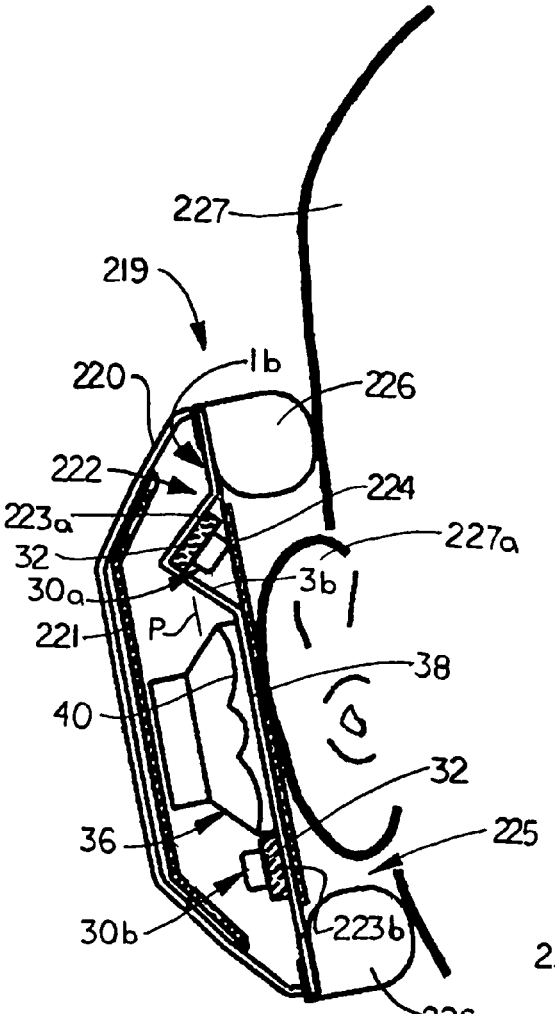
FIG. 13A is a cross-sectional view of a flat baffle plate design for an transducer assembly in an eighth embodiment of the electroacoustic devices.

Referring next to FIG. 13A, in an eighth embodiment each transducer assembly 219 includes a generally concave housing 220 and a piece of outer acoustic foam 221 typically provided on the interior surface of the housing 220. An angled cavity flat baffle plate 1*b* (FIG. 5B) is mounted to the housing 220 to define an outer cavity 222 between the housing 220 and the rear surface of the parallel baffle plate 1*b*. A speaker 36 is mounted to the baffle plate 1*b*. A flat piece of microphone acoustic foam 223*a* is provided on one of the angled surfaces of the bi-angled microphone recess 3*b* in the baffle plate 1*b*. The face 32 of a first microphone 30*a*, mounted to the baffle plate 1*b* inside the microphone recess 3*b*, faces the microphone acoustic foam 223*a*. A second flat piece of microphone acoustic foam 223*b* is provided on the rear surface of the rim 4*b* of the baffle plate 1*b*, and the face 32 of a second microphone 30*b*, mounted to the baffle plate 1*b*, faces the microphone acoustic foam 223*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face generally opposite directions, and the face 32 of the first microphone 30*a* is angled or oriented away from the speaker 36 at an angle of typically about 1-90 degrees with respect to the front 38 of the speaker 36. The face 32 of the second microphone 30*b* and the front 38 of the speaker 36 face substantially the same direction. A sheet of inner acoustic foam 224 is provided on the interior surface of the baffle plate 1*b* and covers the first microphone 30*a* in the microphone recess 3*b*. An ear cushion 226 is provided on the inner surface of the rim 4*b* of the baffle plate 1*b* to cushion the transducer assembly 219 against the head 227 of a wearer as the transducer assembly 219 fits over the wearer's ear 227*a*. An inner cavity 225 is defined by the ear cushion 226 between the inner acoustic foam 224 and the wearer's head 227. A simple signal processing circuit 89 which is suitable for the transducer assembly 219 is shown in FIG. 1D.

Figure 13B:
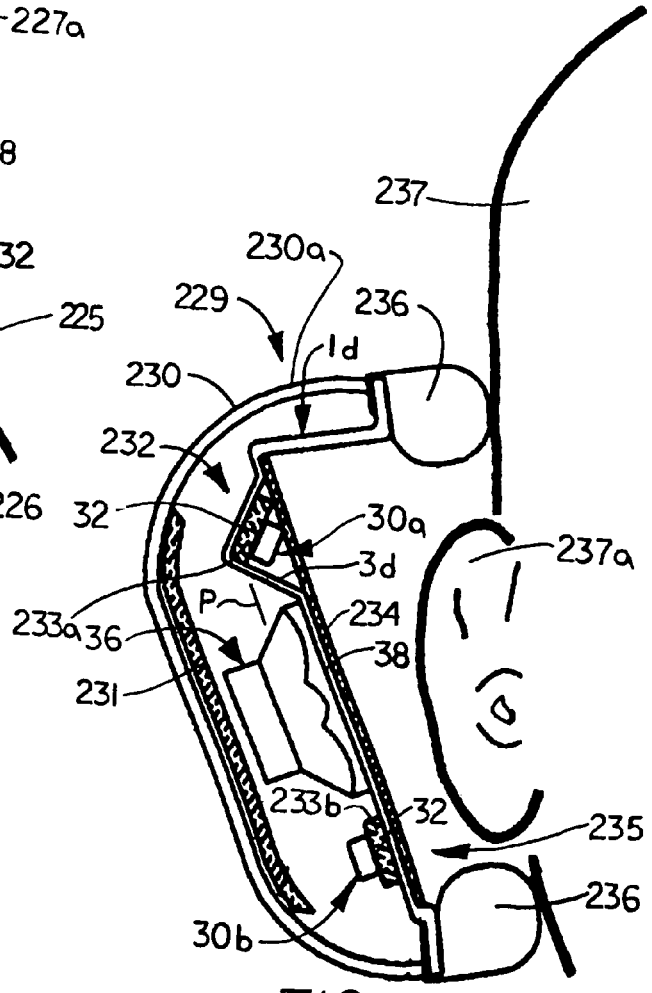
FIG. 13B is a cross-sectional view of a slant baffle plate design for an transducer assembly in an eighth embodiment of the electroacoustic devices.

Referring next to FIG. 13B, in an alternative eighth embodiment each transducer assembly 229 includes a generally concave housing 230 which includes a housing extension 230*a* in the upper portion thereof to facilitate positioning of the interior transducer assembly components away from the ear 237*a* of a wearer. A piece of outer acoustic foam 231 is typically provided on the interior surface of the housing 230. An angled cavity slant baffle plate 1*d* is mounted to the housing 230. An outer cavity 232 is defined between the housing 230 and the rear surface of the baffle plate 1*d*. A speaker 36 is typically mounted to the rear surface of the baffle plate 1*d*. A flat piece of microphone acoustic foam 233*a* is provided on one of the angled surfaces of the bi-angled microphone recess 3*d* in the baffle plate 1*d*. The face 32 of a first microphone 30*a*, mounted to the baffle plate 1*d* inside the microphone recess 3*d*, faces the microphone acoustic foam 233*a*. A second flat piece of microphone acoustic foam 233*b* is provided on the rear surface of the rim 4*d* of the baffle plate 1*d*. The face 32 of a second microphone 30*b* is mounted to the baffle plate 1*d* and faces the microphone acoustic foam 233*b*. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face generally opposite directions, and the face 32 of the first microphone 30*a* is angled or oriented away from the speaker 36 at an angle of typically about 1-90 degrees with respect to the front 38 of the speaker 36. The face 32 of the second microphone 30*b* and the front 38 of the speaker 36 face substantially the same direction. A sheet of inner acoustic foam 234 is provided on the interior surface of the baffle plate 1*d* and covers the first microphone 30*a* in the microphone recess 3*d*. An ear cushion 236 is provided on the exterior surface of the rim 4*d* of the baffle plate 1*d* to cushion the transducer assembly 229 against the head 237 of a wearer. An inner cavity 235 is defined by the ear cushion 236 between the inner acoustic foam 234 and the wearer's head 237. Due to the slanted configuration of the baffle plate 1*d* in combination with the housing extension 230*a* of the housing 230, the first microphone 30*a*, the second microphone 30*b* and the speaker 36 are angled away from the ear 237*a* of the wearer, across the inner cavity 235. A simple signal processing circuit 89 which is suitable for the transducer assembly 229 is shown in FIG. 1D.

Figure 14A:
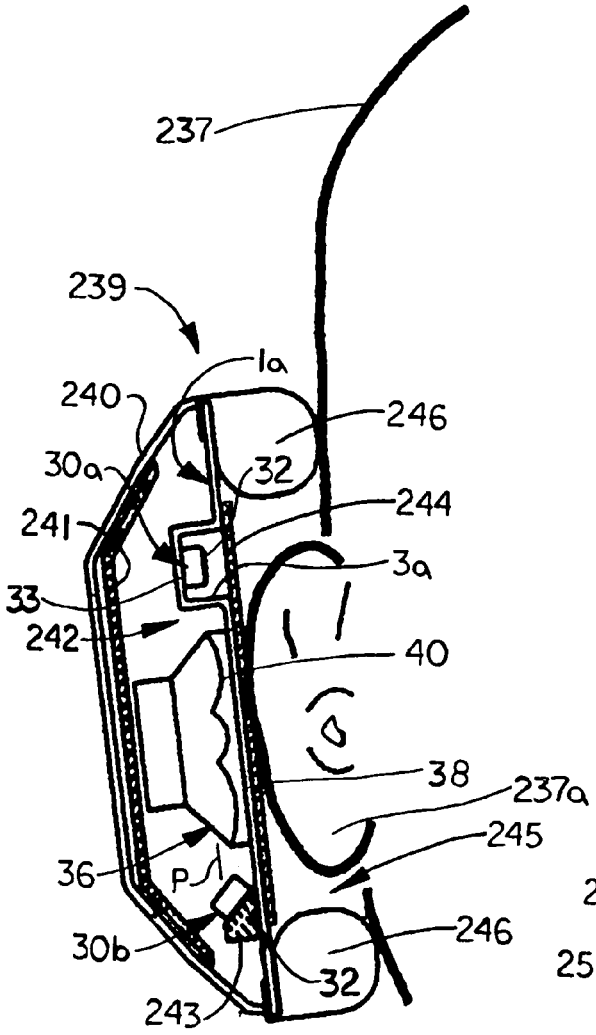
FIG. 14A is a cross-sectional view of a flat baffle plate design for an transducer assembly in a ninth embodiment of the electroacoustic devices.

Referring next to FIG. 14A, in a ninth embodiment each transducer assembly 239 includes a generally concave housing 240 and a piece of outer acoustic foam 241 typically provided on the interior surface of the housing 240. A parallel cavity flat baffle plate 1*a* is mounted to the housing 240 to define an outer cavity 242 between the housing 240 and the rear surface of the parallel cavity flat baffle plate 1*a*. A speaker 36 is mounted to the baffle plate 1*a*. The back 33 of a first speaker 30*a* is mounted to the baffle plate 1*a* inside the microphone recess 3*a*. An angled piece of microphone acoustic foam 243 is provided on the rear surface of the rim 4*a* of the baffle plate 1*a*, and the face 32 of a second microphone 30*b* mounted to the baffle plate 1*a* faces the microphone acoustic foam 243. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face substantially the same direction, whereas the face 32 of the second microphone 30*b* and the front 38 of the speaker 36 face generally the same direction. The face 32 of the first microphone 30*a* is angled or tilted away from the speaker 36, toward the microphone acoustic foam 243 at an angle of typically about 1-90 degrees with respect to the front 38 of the speaker 36. A sheet of inner acoustic foam 244 is provided on the interior surface of the baffle plate 1*a* and covers the first microphone 30*a* in the microphone recess 3*a*. An ear cushion 246 is provided on the inner surface of the rim 4*a* of the baffle plate 4 to cushion the transducer assembly 239 against the head 207 of a wearer as the transducer assembly 239 fits over the wearer's ear 247*a*. An inner cavity 245 is defined by the ear cushion 246 between the inner acoustic foam 244 and the wearer's head 237. A simple signal processing circuit 89 which is suitable for the transducer assembly 239 is shown in FIG. 1D.

Figure 14B:
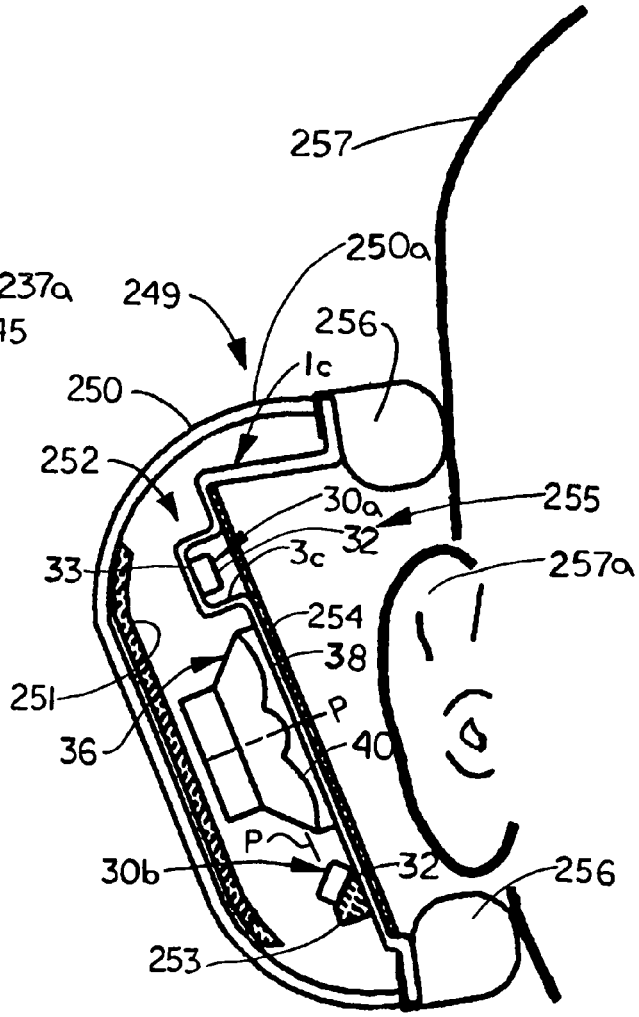
FIG. 14B is a cross-sectional view of a slant baffle plate design for an transducer assembly in a ninth embodiment of the electroacoustic devices.

Referring next to FIG. 14B, in an alternative ninth embodiment each transducer assembly 249 includes a generally concave housing 250 which includes a housing extension 250*a* in the upper portion thereof to facilitate positioning of the interior transducer assembly components away from the ear 257*a* of a wearer. A piece of outer acoustic foam 251 is typically provided on the interior surface of the housing 250. A parallel cavity slant baffle plate 1*c* is mounted to the housing 250. An outer cavity 252 is defined between the housing 250 and the rear surface of the baffle plate 1*c*. A speaker 36 is typically mounted to the rear surface of the baffle plate 1*c*. The back 33 of a first microphone 30*a* is mounted to the baffle plate 1*c* inside the microphone recess 3*c*. An angled piece of microphone acoustic foam 253 is provided on the rear surface of the rim 4*a* of the baffle plate 1*c*, and the face 32 of a second microphone 30*b* mounted at an angle on the baffle plate 1*c* faces the microphone acoustic foam 253. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face substantially the same direction, whereas the face 32 of the second microphone 30*b* and the front 38 of the speaker 36 face generally the same direction. The face 32 of the first microphone 30*a* is angled or tilted away from the speaker 36, toward the microphone acoustic foam 253 at an angle of typically about 1-90 degrees with respect to the front 38 of the speaker 36. A sheet of inner acoustic foam 254 is provided on the interior surface of the baffle plate 1*c* and covers the first microphone 30*a* in the microphone recess 3*c*. An ear cushion 256 is provided on the exterior surface of the rim 4*c* of the baffle plate 1*c* to cushion the transducer assembly 249 against the head 257 of a wearer. An inner cavity 255 is defined by the ear cushion 256 between the inner acoustic foam 254 and the wearer's head 257. Due to the slanted configuration of the baffle plate 1*c* in combination with the housing extension 250*a* of the housing 250, the first microphone 30*a*, the second microphone 30*b* and the speaker 36 are oriented away from the ear 257*a* of the wearer, across the inner cavity 255.

Figure 15A:
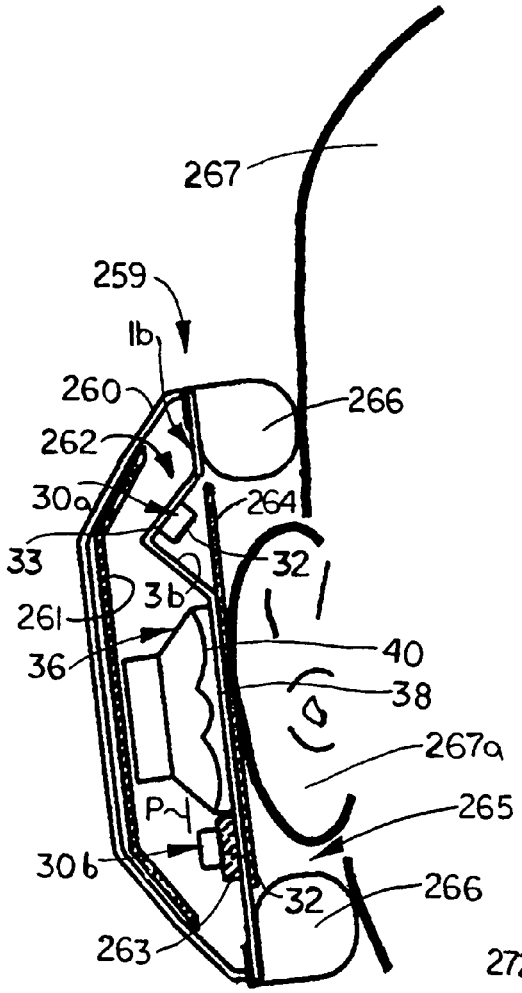
FIG. 15A is a cross-sectional view of a flat baffle plate design for an transducer assembly in a tenth embodiment of the electroacoustic devices.

Referring next to FIG. 15A, in a tenth embodiment each transducer assembly 259 includes a generally concave housing 260 and a piece of outer acoustic foam 261 typically provided on the interior surface of the housing 260. An angled cavity flat baffle plate 1*b* (FIG. 5B) is mounted to the housing 260 to define an outer cavity 262 between the housing 260 and the rear surface of the parallel baffle plate 1*b*. A speaker 36 is mounted to the baffle plate 1*b*. The back 33 of a first microphone 30*a* is mounted on one of the angled surfaces of the bi-angled microphone recess 3*b* in the baffle plate 1*b*. A piece of microphone acoustic foam 263 is provided on the rear surface of the rim 4*b* of the baffle plate 1*b*, and the face 32 of a second microphone 30*b* mounted to the baffle plate 1*b* faces the microphone acoustic foam 263. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face generally the same direction, and the microphone face 32 is angled or oriented toward the speaker 36 at an angle of typically about 1-90 degrees with respect to the front 38 of the speaker 36. The face 32 of the second microphone 30*b* and the front 38 of the speaker 36 face substantially the same direction. A sheet of inner acoustic foam 264 is provided on the interior surface of the baffle plate 1*b* and covers the first microphone 30*a* in the microphone recess 3*b*. An ear cushion 266 is provided on the inner surface of the rim 4*b* of the baffle plate 1*b* to cushion the transducer assembly 259 against the head 267 of a wearer as the transducer assembly 259 fits over the wearer's ear 267*a*. An inner cavity 265 is defined by the ear cushion 266 between the inner acoustic foam 264 and the wearer's head 267. A simple signal processing circuit 89 which is suitable for the transducer assembly 259 is shown in FIG. 1D, except the faces 32 of the first microphone 30*a* and the second microphone 30*b* are oriented in generally the same direction.

Figure 15B:
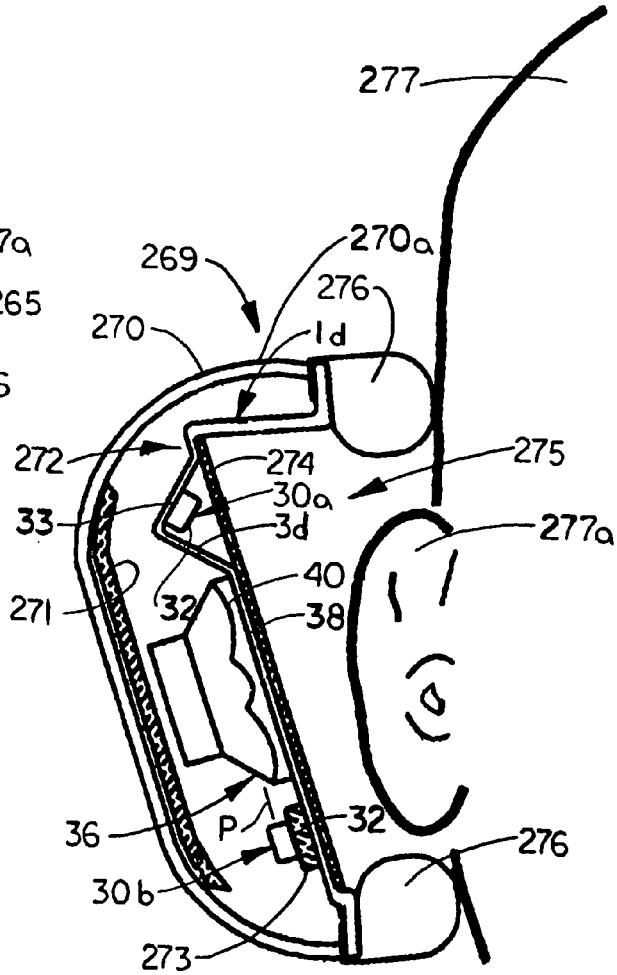
FIG. 15B is a cross-sectional view of a slant baffle plate design for an transducer assembly in a tenth embodiment of the electroacoustic devices.

Referring next to FIG. 15B, in an alternative tenth embodiment each transducer assembly 269 includes a generally concave housing 270 which includes a housing extension 270*a* in the upper portion thereof to facilitate positioning of the interior transducer assembly components away from the ear 277*a* of a wearer. A piece of outer acoustic foam 271 is typically provided on the interior surface of the housing 270. An angled cavity slant baffle plate 1*d* is mounted to the housing 270. An outer cavity 272 is defined between the housing 270 and the rear surface of the baffle plate 1*d*. A speaker 36 is typically mounted to the rear surface of the baffle plate 1*d*. The back 33 of a first microphone 30*a* is provided on one of the angled surfaces of the bi-angled microphone recess 3*d* in the baffle plate 1*d*. A flat piece of microphone acoustic foam 273 is provided on the rear surface of the rim 4*d* of the baffle plate 1*d*, and the face 32 of a second microphone 30*b* mounted to the baffle plate 1*d* faces the microphone acoustic foam 273. The diaphragm 34 (FIG. 2) of the first microphone 30*a*, the diaphragm 34 of the second microphone 30*b* and the diaphragm 40 of the speaker 36 are disposed in substantially the same acoustic plane "P". The face 32 of the first microphone 30*a* and the front 38 of the speaker 36 face generally the same direction, and the microphone face 32 is angled or oriented toward the speaker 36 at an angle of typically about 1-90 degrees with respect to the front 38 of the speaker 36. The face 32 of the second microphone 30*b* and the front 38 of the speaker 36 face substantially the same direction. A sheet of inner acoustic foam 274 is provided on the interior surface of the baffle plate 1*d* and covers the first microphone 30*a* in the microphone recess 3*d*. An ear cushion 276 is provided on the exterior surface of the rim 4*d* of the baffle plate 1*d* to cushion the transducer assembly 269 against the head 277 of a wearer. An inner cavity 275 is defined by the ear cushion 276 between the inner acoustic foam 274 and the wearer's head 277. Due to the slanted configuration of the baffle plate 1*d* in combination with the housing extension 270*a* of the housing 270, the first microphone 30*a*, the second microphone 30*b* and the speaker 36 are angled away from the ear 277*a* of the wearer, across the inner cavity 275.

Figure 16:
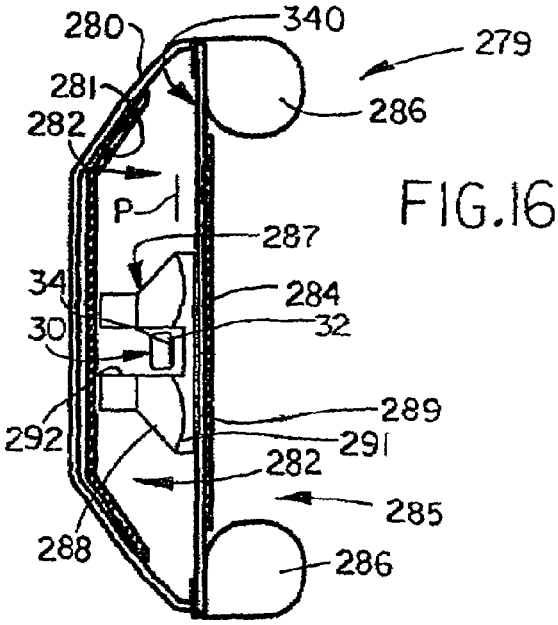
FIG. 16 is a cross-sectional view of an transducer assembly in an eleventh embodiment of the electroacoustic devices.

Referring next to FIG. 16, in an eleventh embodiment each transducer assembly 279 of the electroacoustic device 10 includes a generally concave housing 280. A piece of outer acoustic foam 281 is typically provided on the interior surface of the housing 280. A standard or conventional, generally planar baffle plate 340 is mounted to the housing 280. Accordingly, an outer cavity 282 is defined between the housing 280 and the rear surface of the baffle plate 340, with the outer acoustic foam 281 provided in the outer cavity 282. A speaker 287 is typically mounted to the rear surface of the baffle plate 340. The speaker 287 includes a speaker housing 288 having a front 289 disposed in communication with a speaker opening (not shown) provided in the baffle plate 340. A speaker diaphragm 291 is provided in the speaker housing 288, and a central opening 292 extends through the speaker housing 288 and through the diaphragm 291. A microphone 30 is mounted to the speaker housing 288, inside the central opening 292. The face 32 of the microphone 30 faces substantially the same direction as the front 289 of the speaker housing 288, and the diaphragm 34 of the microphone 30 and the diaphragm 291 of the speaker 287 are disposed in substantially the same acoustic plane "P". A sheet of inner acoustic foam 284 is provided on the interior surface of the baffle plate 340. An ear cushion 286 is provided on the exterior surface of the baffle plate 340 to cushion the transducer assembly 279 against the head of a wearer. An inner cavity 285 is defined by the ear cushion 286 and between the inner acoustic foam 284 and the wearer's head (not shown). The transducer assembly 279 may be used in conjunction with the signal processing circuit 80 heretofore described with respect to FIG. 1B.

Figure 17:
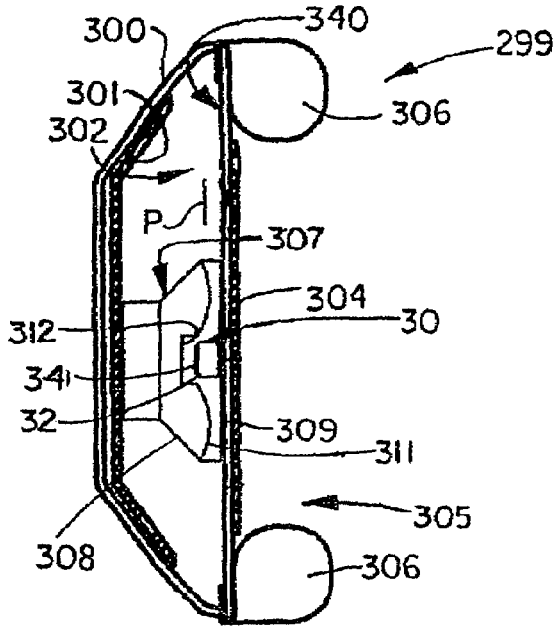
FIG. 17 is a cross-sectional view of an transducer assembly in a twelfth embodient of the electroacoustic devices.

Referring next to FIG. 17, in a twelfth embodiment each transducer assembly 299 of the electroacoustic device 10 includes a generally concave housing 300 having a piece of outer acoustic foam 301 typically provided on the interior surface of the housing 300. A standard or conventional, generally planar baffle plate 340 is mounted to the housing 300. An outer cavity 302 is defined between the housing 300 and the rear surface of the baffle plate 340, with the outer acoustic foam 301 provided in the outer cavity 302. A speaker 307 is typically mounted to the rear surface of the baffle plate 340. The speaker 307 includes a speaker housing 308 having a front 309 disposed in communication with a speaker opening (not shown) provided in the baffle plate 340. A speaker diaphragm 311 is provided in the speaker housing 308, and a central opening 312 extends through the speaker housing 308 and through the diaphragm 311. A microphone 30 is mounted to the speaker housing 308, inside the central opening 312. The face 32 of the microphone 30 and the front 309 of the speaker housing 308 face substantially opposite directions, and the diaphragm 34 of the microphone 30 and the diaphragm 311 of the speaker 307 are disposed in substantially the same acoustic plane "P". A sheet of inner acoustic foam 304 is provided on the interior surface of the baffle plate 340. An ear cushion 306 is provided on the exterior surface of the baffle plate 340 to cushion the transducer assembly 299 against the head of a wearer. An inner cavity 305 is defined by the ear cushion 306 and between the inner acoustic foam 304 and the wearer's head (not shown). The transducer assembly 299 may be used in conjunction with the signal processing circuit 87 heretofore described with respect to FIG. 1B.

Figure 18:
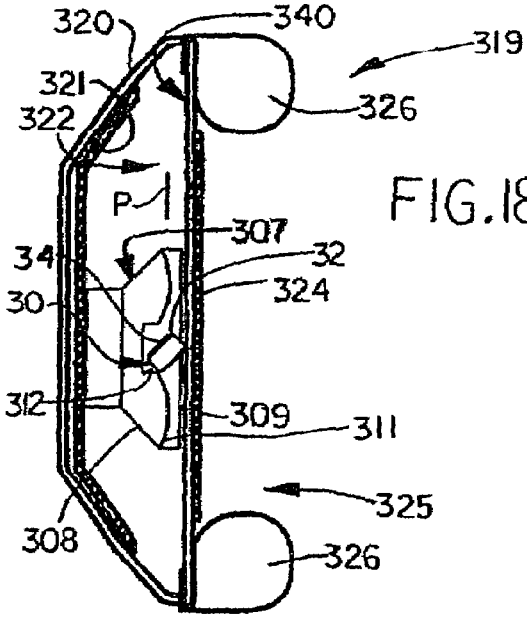
FIG. 18 is a cross-sectional view of an transducer assembly in a thirteenth embodiment of the electroacoustic devices.

Referring next to FIG. 18, in a thirteenth embodiment each transducer assembly 319 of the electroacoustic device 10 includes a generally concave housing 320 having a piece of outer acoustic foam 321 typically provided on the interior surface of the housing 320. A standard or conventional, generally planar baffle plate 340 is mounted to the housing 320. An outer cavity 322 is defined between the housing 320 and the rear surface of the baffle plate 340, with the outer acoustic foam 321 provided in the outer cavity 322. A speaker 307, such as that heretofore described with respect to FIG. 17, is typically mounted to the rear surface of the baffle plate 340. The speaker 307 includes a speaker housing 308 having a front 309 disposed in communication with a speaker opening (not shown) provided in the baffle plate 340. A speaker diaphragm 311 is provided in the speaker housing 308, and a central opening 312 extends through the speaker housing 308 and through the diaphragm 311. A microphone 30 is mounted to the speaker housing 308, inside the central opening 312. The face 32 of the microphone 30 and the front 309 of the speaker housing 308 face generally opposite directions, and the diaphragm 34 of the microphone 30 and the diaphragm 311 of the speaker 307 are disposed in substantially the same acoustic plane "P". The diaphragm 34 of the microphone 30 is disposed at an angle of typically about 0-90 degrees with respect to the diaphragm 311 of the speaker 307, and the face 32 of the microphone 30 faces the diaphragm 311. A sheet of inner acoustic foam 324 is provided on the interior surface of the baffle plate 340. An ear cushion 326 is provided on the exterior surface of the baffle plate 340 to cushion the transducer assembly 319 against the head of a wearer. An inner cavity 325 is defined by the ear cushion 326 and between the inner acoustic foam 324 and the wearer's head (not shown). The transducer assembly 319 may be used in conjunction with the signal processing circuit 87 heretofore described with respect to FIG. 1C, except with the face 32 of the speaker 30 disposed at an angle with respect to the diaphragm 311 of the speaker 307 (FIG. 18).

Figure 19:
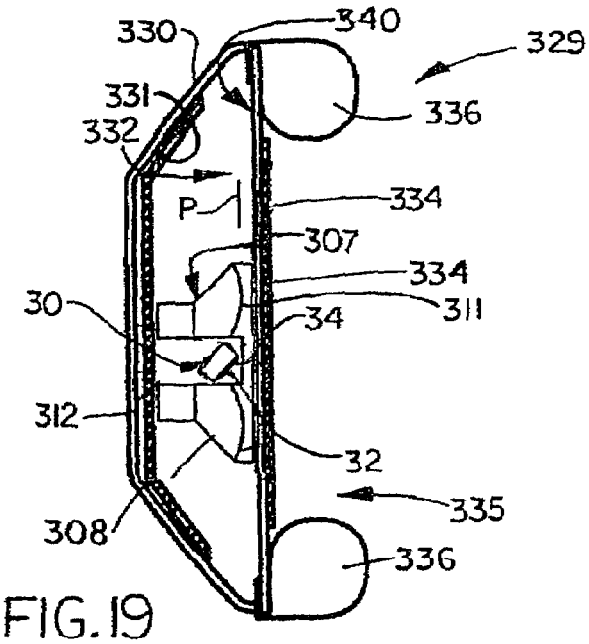
FIG. 19 is a cross-sectional view of an transducer assembly in a fourteenth embodiment of the electroacoustic devices.

Referring next to FIG. 19, in a fourteenth embodiment each transducer assembly 329 of the electroacoustic device 10 includes a generally concave housing 330 having a piece of outer acoustic foam 331 typically provided on the interior surface of the housing 330. A standard or conventional, generally planar baffle plate 340 is mounted to the housing 330. An outer cavity 332 is defined between the housing 330 and the rear surface of the baffle plate 340, with the outer acoustic foam 331 provided in the outer cavity 332. A speaker 307, such as that heretofore described with respect to FIG. 17, is typically mounted to the rear surface of the baffle plate 340. The speaker 307 includes a speaker housing 308 having a front 309 disposed in communication with a speaker opening (not shown) provided in the baffle plate 340. A speaker diaphragm 311 is provided in the speaker housing 308, and a central opening 312 extends through the speaker housing 308 and through the diaphragm 311. A microphone 30 is mounted to the speaker housing 308, inside the central opening 312. The face 32 of the microphone 30 and the front 309 of the speaker housing 308 face generally the same direction, and the diaphragm 34 of the microphone 30 and the diaphragm 311 of the speaker 307 are disposed in substantially the same acoustic plane "P". The diaphragm 34 of the microphone 30 is disposed at an angle of typically about 1-90 degrees with respect to the diaphragm 311 of the speaker 307. A sheet of inner acoustic foam 334 is provided on the interior surface of the baffle plate 340. An ear cushion 336 is provided on the exterior surface of the baffle plate 340 to cushion the transducer assembly 329 against the head of a wearer. An inner cavity 335 is defined by the ear cushion 336 and between the inner acoustic foam 334 and the wearer's head (not shown). The transducer assembly 329 may be used in conjunction with the signal processing circuit 80 heretofore described with respect to FIG. 1B, except with the face 32 of the speaker 30 disposed at an angle with respect to the diaphragm 311 (FIG. 19) of the speaker 307.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. An electroacoustic device having at least one transducer assembly comprising:

a generally planar baffle plate having inner cavity and outer cavity surfaces, and a microphone recess for positioning a microphone adjacent to the baffle plate surface;

a speaker having a speaker diaphragm for converting input electrical signals into sound waves, wherein the speaker is positioned facing the outer cavity baffle plate surface;

a microphone having a microphone diaphragm for converting sound waves into electrical signals, wherein the microphone is positioned adjacent to the baffle plate, the microphone faces generally the baffle plate surface, optional microphone acoustic foam overlays the microphone face and is positioned generally between the microphone face and the baffle plate surface, and the speaker diaphragm and the microphone diaphragm are positioned in substantially a common acoustic plane; and a circuit operably connected to the speaker and the microphone for modifying the electrical signals from the microphone and transmitting the electrical signals to the speaker.

2. The device of claim 1 wherein the microphone and the speaker face generally opposite directions.

3. The device of claim 1 wherein the microphone and the speaker face generally the same direction.

4. The device of claim 1 further comprising a second microphone positioned adjacent to the baffle plate, wherein the microphone and the speaker face generally a first direction, the second microphone faces generally a second direction substantially opposite the first direction, and optional microphone acoustic foam overlays the second microphone face.

5. The device of claim 1 further comprising a second microphone positioned adjacent to the baffle plate, wherein the microphone faces a first direction, the speaker faces a second direction substantially opposite the first direction, the second microphone faces generally the second direction but is oriented at a non-perpendicular angle relative to the speaker, and optional microphone acoustic foam overlays the second microphone face.

6. The device of claim 1 further comprising a second microphone positioned adjacent to the baffle plate, wherein the microphone and the speaker face substantially the same direction, the second microphone faces generally the same direction but is oriented at a non-perpendicular angle relative to the speaker, and optional microphone acoustic foam overlays the second microphone face.

7. The device of claim 1 wherein the microphone is positioned adjacent to the baffle plate, and wherein the microphone faces an angle that is not perpendicular relative to the speaker.

8. The device of claim 7 wherein the microphone and the speaker face generally opposite directions.

9. The device of claim 8 further comprising a second microphone positioned adjacent to the baffle plate, wherein the second microphone and the speaker face generally the same direction, and optional microphone acoustic foam overlays the second microphone face.

10. The device of claim 8 further comprising a second microphone positioned adjacent to the baffle plate, and wherein the second microphone and the speaker face generally opposite directions, and optional microphone acoustic foam overlays the second microphone face.

11. The device of claim 7 wherein the microphone and the speaker face generally the same direction.

12. The device of claim 11 further comprising a second microphone positioned adjacent to the baffle plate, and wherein the second microphone and the speaker face substantially the same direction, and optional microphone acoustic foam overlays the second microphone face.

13. An electroacoustic device having at least one transducer assembly comprising:

a speaker comprising a housing, a speaker diaphragm for converting input electrical signals into sound waves, and a central cavity provided in the speaker, wherein the cavity has an opening to the front or to the rear of the speaker;

a microphone having a microphone diaphragm for converting sound waves into electrical signals, wherein the microphone is positioned within a central cavity of the speaker, the microphone faces generally a sound-reflecting surface, optional microphone acoustic foam overlays the microphone face and is positioned generally between the microphone face and the surface, and the speaker diaphragm and the microphone diaphragm are positioned in substantially a common acoustic plane; and a circuit operably connected to the speaker and the microphone for modifying the electrical signals and transmitting the electrical signals to the speaker.

14. The device of claim 13 wherein the microphone and the speaker face substantially the same direction.

15. The device of claim 13 wherein the microphone and the speaker face substantially opposite directions.

16. The device of claim 13 wherein the microphone further is positioned at an angle that is neither perpendicular nor parallel relative to the speaker face.

17. The device of claim 16 wherein the microphone and the speaker face generally the same direction.

18. The device of claim 16 wherein the microphone and the speaker face generally opposite directions.

19. A method for minimizing undesirable noise reduction acoustic properties associated with differences in at least one of sensitivity, frequency response, and phase response or acoustic time delay between a microphone and a speaker in a transducer assembly, the method comprising orienting the microphone face generally toward an adjacent surface to minimize direct sound reflections that originate from the speaker and are received by the microphone from at least one of an inner or outer cavity of the transducer assembly.

20. The method of claim 19 wherein the surface is a baffle plate.

* * * * *